US008360900B2

(12) United States Patent
Snyder

(10) Patent No.: US 8,360,900 B2
(45) Date of Patent: Jan. 29, 2013

(54) GOLF CLUB ASSEMBLY AND GOLF CLUB WITH AERODYNAMIC FEATURES

(75) Inventor: Jeremy N. Snyder, Benbrook, TX (US)

(73) Assignee: NIKE, Inc., Beaverton, OR (US)

( * ) Notice: Subject to any disclaimer, the term of this patent is extended or adjusted under 35 U.S.C. 154(b) by 221 days.

(21) Appl. No.: 12/754,772

(22) Filed: Apr. 6, 2010

(65) Prior Publication Data

US 2011/0244979 A1 Oct. 6, 2011

(51) Int. Cl.
*A63B 53/04* (2006.01)

(52) U.S. Cl. ..... 473/327; 473/345

(58) Field of Classification Search ..... 473/327
See application file for complete search history.

(56) References Cited

U.S. PATENT DOCUMENTS

D192,515 S * 4/1962 Henrich ..... D21/733
5,193,810 A 3/1993 Antonious
5,221,086 A 6/1993 Antonious
5,318,297 A 6/1994 Davis et al.
5,456,469 A 10/1995 MacDougall
5,505,448 A 4/1996 Park
5,511,786 A * 4/1996 Antonious ..... 473/327
6,773,359 B1 8/2004 Lee
7,641,568 B2 1/2010 Hoffman et al.

FOREIGN PATENT DOCUMENTS

WO 2004022171 A1 3/2004

OTHER PUBLICATIONS

International Search Report and Written Opinion issued Jun. 17, 2011 in corresponding PCT Application No. PCT/US2011/031038.

* cited by examiner

*Primary Examiner* — Michael Dennis
(74) *Attorney, Agent, or Firm* — Banner & Witcoff, Ltd.

(57) ABSTRACT

A golf club head has a body member that includes a ball striking face, a crown region, a toe region, a heel region, a sole region, a rear region and a hosel region. The body member has a drag-reduction feature that may include first and second elongated fins. The fins extend in a generally front-to-rear orientation. The fins are spaced farther apart at their forward-most ends than at their rearward-most ends. Alternatively, the drag-reduction feature may include first and second elongated indentations. The indentations extend in a generally front-to-rear orientation. The indentations are spaced farther apart at their forward-most ends than at their rearward-most ends. The drag-reduction features may be located on one or both of the crown region or the sole region. A golf club including the golf club head is also provided.

13 Claims, 13 Drawing Sheets

GOLF CLUB ASSEMBLY AND GOLF CLUB WITH AERODYNAMIC FEATURES

FIELD

Aspects of this invention relate generally to golf clubs and golf club heads, and, in particular, to golf clubs and golf club heads with aerodynamic features.

BACKGROUND

The distance a golf ball travels when struck by a golf club is determined in large part by club head speed at the point of impact with the golf ball. Club head speed in turn can be affected by the wind resistance or drag provided by the club head during the entirety of the swing, especially given the large club head size of a driver. The club head of a driver or a fairway wood in particular produces significant aerodynamic drag during its swing path. The drag produced by the club head leads to reduced club head speed and, therefore, reduced distance of travel of the golf ball after it has been struck.

Air flows in a direction opposite to the golf club head's trajectory over those surfaces of the golf club head that are roughly parallel to the direction of airflow. An important factor affecting drag is the behavior of the air flow's boundary layer. The "boundary layer" is a thin layer of air that lies very close to the surfaces of the golf club head during its motion. As the airflow moves over the surfaces, it encounters an increasing pressure. This increase in pressure is called an "adverse pressure gradient" because it causes the airflow to slow down and lose momentum. As the pressure continues to increase, the airflow continues to slow down until it reaches a speed of zero, at which point it separates from the surface. The air stream will hug the club head's surfaces until the loss of momentum in the airflow's boundary layer causes it to separate from the surface. The separation of the air streams from the surfaces results in a low pressure separation region behind the club head (i.e., at the trailing edge as defined relative to the direction of air flowing over the club head). This low pressure separation region creates pressure drag. The larger the separation region, the larger the pressure drag.

One way to reduce or minimize the size of the low pressure separation region is by providing a streamlined form that allows laminar flow to be maintained for as long as possible, thereby delaying or eliminating the separation of the laminar air stream from the club surface.

Reducing the drag of the club head at the point of impact (and, if possible, also prior to the moment of impact) would result in improved club head speed and increased distance of travel of the golf ball. When analyzing the swing of professional golfers, it has been noted that, although the heel/hosel area of the club head leads the swing during a significant portion of the downswing, the ball striking face leads the swing at (or immediately before) the point of impact with the golf ball. The phrase "leading the swing" is meant to describe that portion of the club head that faces the direction of swing trajectory. For purposes of discussion, the golf club and golf club head are considered to be at a 0° orientation when the ball striking face is leading the swing, i.e. at the point of impact. During the final portion of the downswing, the club head is traveling at its maximum speed, which may reach approximately 65 miles per hour (mph) to over 100 mph, and in the case of some professional golfers, to as high as 140 mph. It may be desirable to provide a golf club head with reduced drag when the speed of the club head is greatest.

Club heads that have been designed to reduce the drag of the head at the point of impact, or from the point of view of the club face leading the swing, may actually increase the drag during other phases of the swing cycle, such as when the heel/hosel region of the club head is leading the downswing. Thus, additionally, it may be desirable to provide a golf club head with reduced drag when the speed of the club head is greatest, while not having an increased drag during other portions of the golf swing.

It would be desirable to provide a golf club head that reduces or overcomes some or all of the difficulties inherent in prior known devices. Particular advantages will be apparent to those skilled in the art, that is, those who are knowledgeable or experienced in this field of technology, in view of the following disclosure of the invention and detailed description of certain embodiments.

SUMMARY

This application discloses a golf club head with improved aerodynamic performance. In accordance with certain aspects, a golf club head may include a body member having a ball striking face, a crown, a toe, a heel, a sole, a rear edge, and a hosel region located at the intersection of the ball striking face, the heel, the crown and/or the sole. A drag reducing structure on the body member may be configured to reduce drag for the club head during at least the portion of a golf downswing when the velocity of the golf club head is nearing and/or at its maximum velocity. Generally, as the golf club head approaches maximum velocity, i.e., as it approaches impact with the golf ball, the ball striking face of the club head leads the swing.

In accordance with certain aspects, a golf club head may include a body member having a ball striking face, a crown region, a toe region, a heel region, a sole region, a rear region, and a hosel region located at the intersection of the ball striking face, the heel region, the crown region and/or the sole region. The body member has a drag-reduction feature that may include a first elongated fin and a second elongated fin, the first and second fins extending in a generally ball striking face-to-rear region orientation, each fin having a forward-most end and a rearward-most end, the first and second fins being spaced farther apart at their forward-most ends than at their rearward-most ends.

In accordance with certain other aspects, a golf club head may include a body member having a ball striking face, a crown region, a toe region, a heel region, a sole region, a rear region, and a hosel region located at the intersection of the ball striking face, the heel region, the crown region and/or the sole region. The body member has a drag-reduction feature that may include a first elongated indentation and a second elongated indentation, the first and second indentations extending in a generally ball striking face-to-rear region orientation, each indentation having a forward-most end and a rearward-most end, the first and second indentations being spaced farther apart at their forward-most ends than at their rearward-most ends.

According to additional aspects, the drag-reduction feature may be located on the crown region. Alternatively, the drag-reduction feature may be located on the sole region. Even further, drag-reduction features may be included on both the crown region and the sole region.

According to other aspects, the first and second fins and/or the first and second indentations may converge at their most rearward ends. Further, the first fin and/or the first indentation may be angled from approximately 10 degrees to approximately 45 degrees from a front-to-rear centerline of the club head. The second fin and/or the second indentation may be angled from approximately negative 10 degrees to approximately negative 45 degrees from the front-to-rear centerline of the club head.

According to even other aspects, the forward-most ends of the fins and/or the indentations may be located within 10 mm of the ball-striking face. Additionally or alternatively, the rearward-most ends of the fins and/or the indentations may be located within 10 mm of the rear region.

According to further aspects, a golf club may include the golf club head as described herein that is secured to a first end of a golf club shaft at the club head's hosel region.

These and additional features and advantages disclosed here will be further understood from the following detailed disclosure of certain embodiments.

Figure 1A:
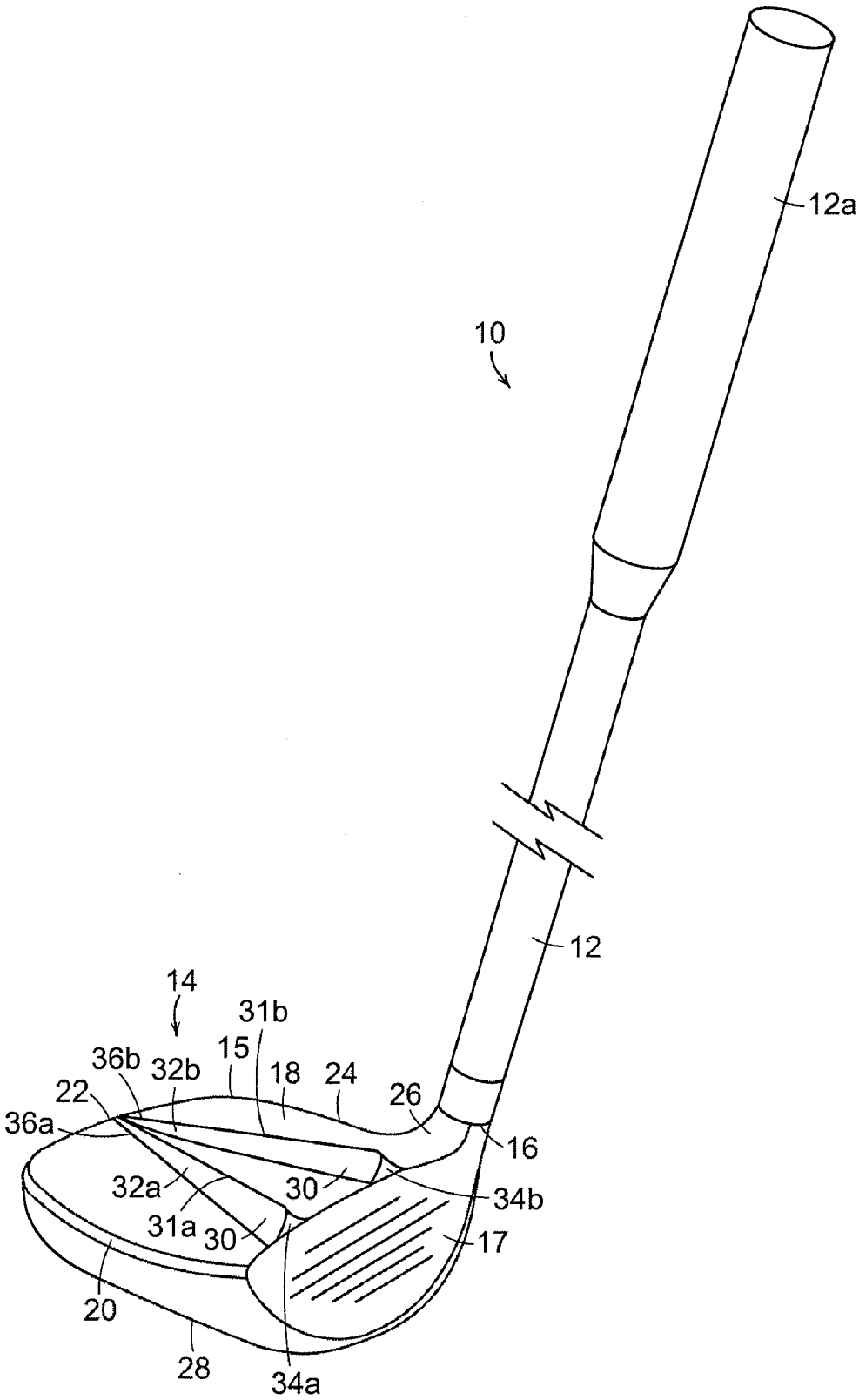
FIG. 1A is a perspective view of a golf club, generally showing the ball striking face, the crown region and the toe region of the club head, with at least one drag-reducing structure included on a surface of the club head according to an illustrative aspect.

The figures referred to above are not drawn necessarily to scale, should be understood to provide a representation of particular embodiments of the invention, and are merely conceptual in nature and illustrative of the principles involved. Some features of the golf club head depicted in the drawings may have been enlarged or distorted relative to others to facilitate explanation and understanding. The same reference numbers are used in the drawings for similar or identical components and features shown in various alternative embodiments. Golf club heads as disclosed herein would have configurations and components determined, in part, by the intended application and environment in which they are used.

DETAILED DESCRIPTION

An illustrative embodiment of a golf club 10 is shown in FIGS. 1A through 3. As best shown in FIG. 1A, golf club 10 includes a shaft 12 and a golf club head 14 attached to the shaft 12. Golf club head 14 may be any driver, wood, or the like. The shaft 12 of the golf club 10 may be made of various materials, such as steel, aluminum, titanium, graphite, or composite materials, as well as alloys and/or combinations thereof, including materials that are conventionally known and used in the art. Additionally, the shaft 12 may be attached to the club head 14 in any desired manner, including in conventional manners known and used in the art (e.g., via adhesives or cements at a hosel element, via fusing techniques (e.g., welding, brazing, soldering, etc.), via threads or other mechanical connectors (including releasable and adjustable connections), via friction fits, via retaining element structures, etc.). A grip or other handle element 12*a* is positioned on the shaft 12 to provide a golfer with a slip resistant surface with which to grasp golf club shaft 12. The grip element 12*a* may be attached to the shaft 12 in any desired manner, including in conventional manners known and used in the art (e.g., via adhesives or cements, via threads or other mechanical connectors (including releasable connections), via fusing techniques, via friction fits, via retaining element structures, etc.).

Figure 2:
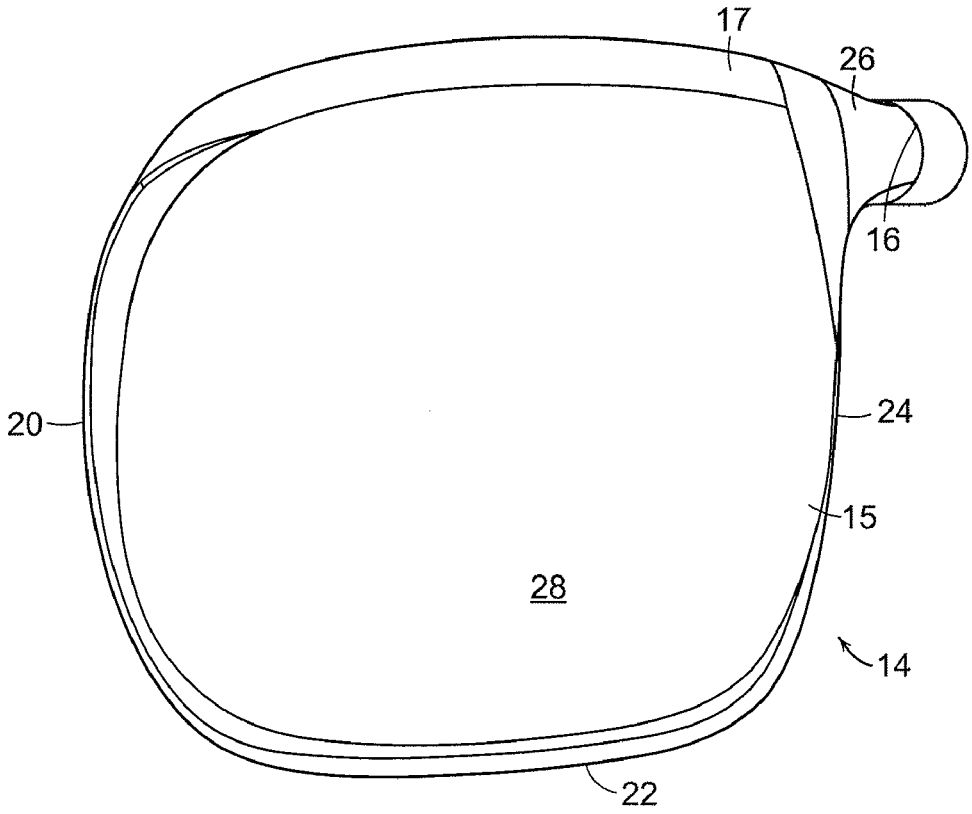
FIG. 2 is a bottom perspective view of the club head of FIG. 1A.
Figure 3:
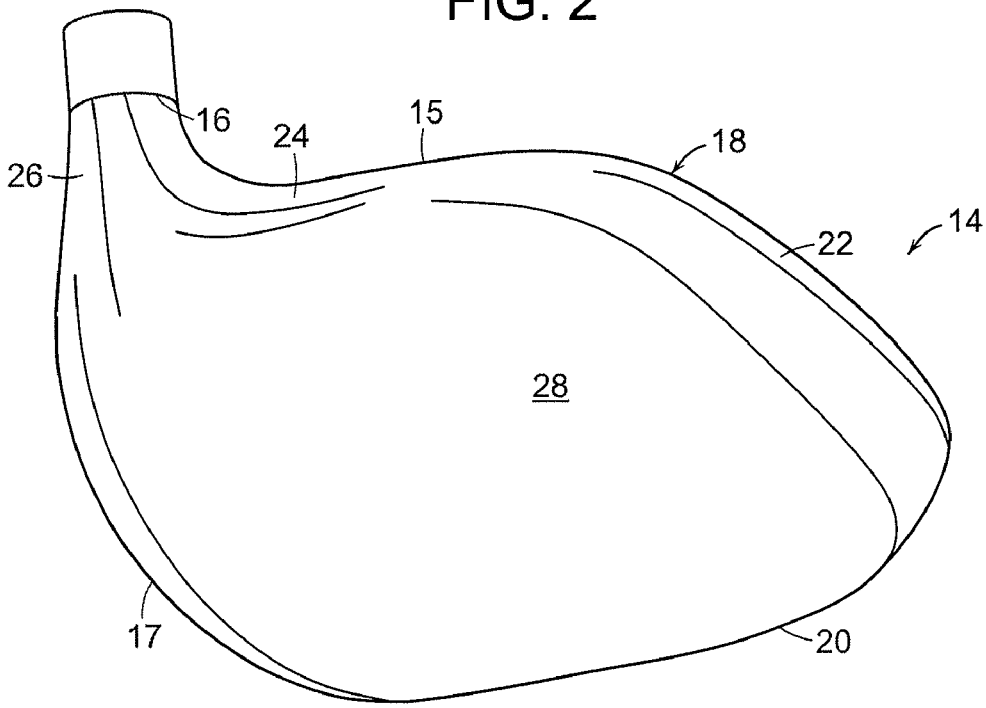
FIG. 3 is a perspective view of the club head of FIG. 1A, generally showing the rear, heel and sole regions of the club head.

In the example structure of FIG. 1A, the club head 14 includes a body member 15 to which the shaft 12 is attached at a hosel 16 in known fashion. The body member 15 further includes a plurality of portions, regions, or surfaces. Referring also to FIGS. 2 and 3, this example body member 15 includes a ball striking face 17, a crown region 18, a toe region 20, a rear region 22, a heel region 24, a hosel region 26 and a sole region 28.

Some of the drag-reducing structures disclosed below provide various means to maintain laminar flow over one or more surfaces of the club head 14 when the ball striking face 17 is generally leading the swing, i.e., when air generally flows over the club head 14 from the ball striking face 17 toward the rear 22.

Figure 4:
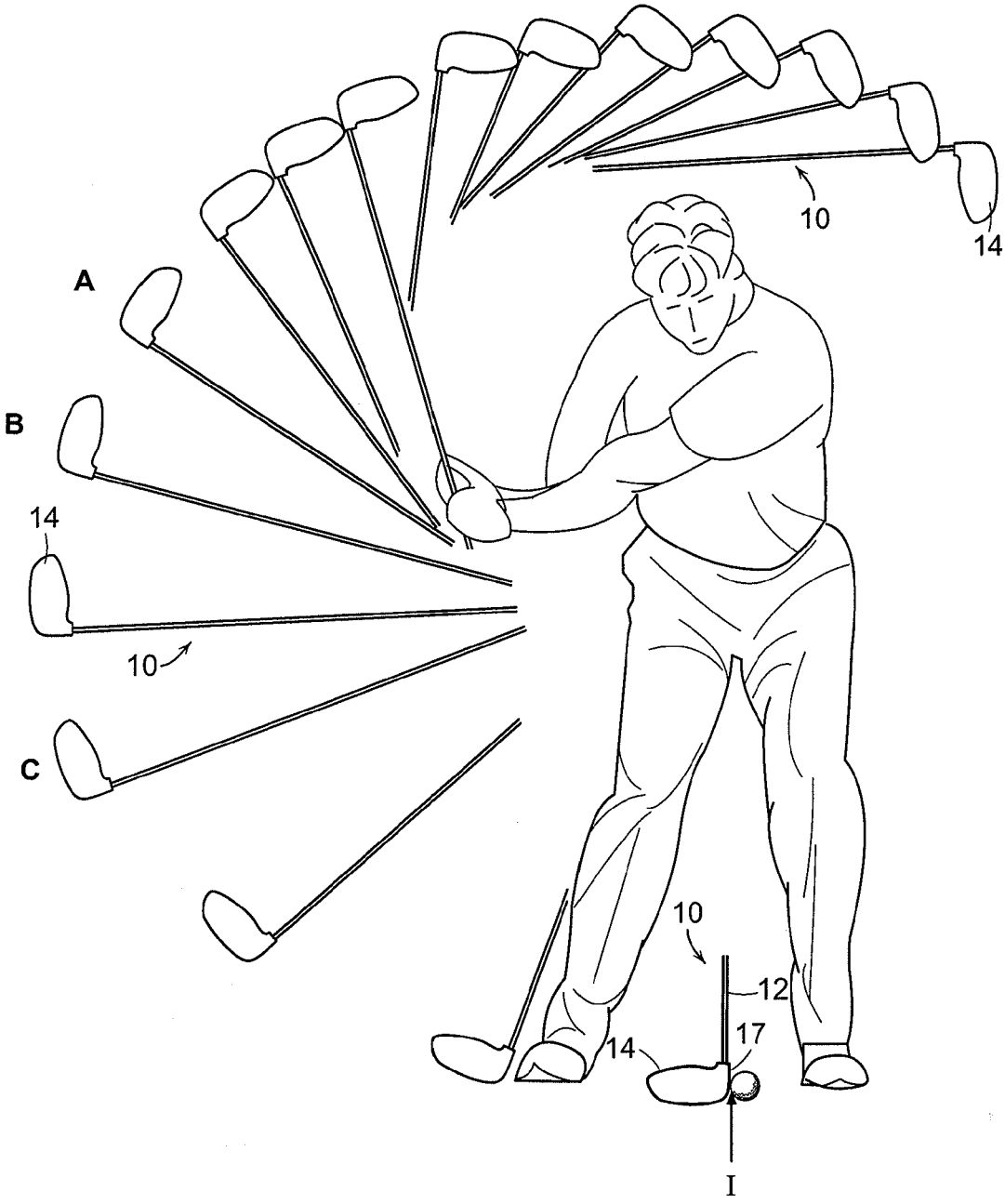
FIG. 4 is a schematic front view of a typical golfer's downswing.

FIG. 4 schematically illustrates a typical golfer's downswing. As shown in FIG. 4, at the point of impact (I) with a golf ball, the ball striking face 17 may be substantially perpendicular to the direction of travel of club head 14 and the flight of the golf ball. During the user's backswing, the user's rotation of his hips, torso, shoulders, arms and/or hands causes the golf club 10 to twist such that yaw (defined herein as rotation around the longitudinal axis of the golf club's shaft 12) is introduced, thereby pivoting the ball striking face 17 out of alignment from its orientation at impact. With the orientation of the ball striking face 17 at the point of impact considered to be 0°, during the backswing, the ball striking face 17 twists outwardly away from the user (i.e., clockwise when viewed from above for a right handed golfer) to a maximum yaw angle of, for example, approximately 130°. Thus, at the beginning of a golfer's downswing, the heel region 24 is essentially leading the swing. At the moment of impact with the golf ball, the ball striking face 17 is essentially leading the swing.

Figure 5:
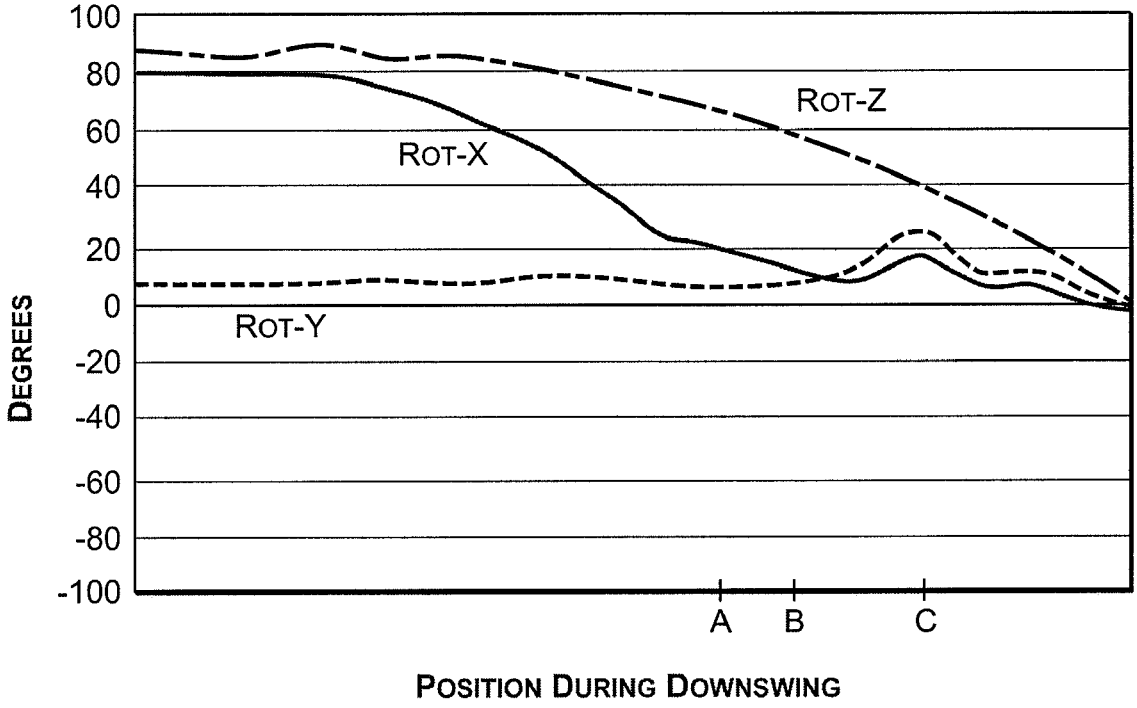
FIG. 5 is a graph of the rotations around the X-, Y- and Z-axes of the golf club as a function of club head position during the typical golfer's downswing as schematically illustrated in FIG. 4.

Referring now to both FIGS. 4 and 5, during the downswing, the orientation of the golf club and club head 14 changes from the 130° of yaw at the beginning of the downswing to the 0° of yaw at the point of impact. Typically, the change in yaw angle over the course of the downswing is not constant. During the first portion of the downswing, when the club head 14 moves from above the golfer's waist near the shoulders to the approximately 90° position shown in FIG. 4, the change in yaw angle is typically on the order of 20° to 40°. Thus, when the club head 14 is approximately waist high, the yaw is approximately 90°, and during the last 90° portion of the downswing (from waist height to the point of impact), the yaw of the golf club generally travels through an angle of about 90° to the yaw of 0° at the point of impact. However, again, the change in yaw angle during this portion of the downswing is not constant, and, in fact, the golf club head 14 typically closes from approximately at least a 20° yaw to the 0° yaw at the point of impact only over the last 10° degrees of the downswing. In fact, over the course of this latter portion of the downswing, an average change in yaw of 45° to 60° may be typical.

The speed of the golf club head also changes during the downswing, from 0 mph at the beginning of the downswing to 65 to 100 mph (or even more, for top-ranked golfers) at the point of impact. At low speed, i.e., during the initial portion of the downswing, drag due to air resistance may not be very significant. However, during the portion of the downswing when club head 14 is even with the golfer's waist and then swinging through to the point of impact, the club head 14 is travelling at a considerable rate of speed (for example, from 60 mph to 140 mph for professional golfers). During this portion of the downswing, drag due to air resistance causes the golf club head 14 to impact the golf ball at a slower speed than would be possible without air resistance. The maximum speed of the golf club head occurs, ideally, at the moment of impact with the golf ball.

Referring back to FIG. 1B, the ball striking face region 17 may be essentially flat or it may have a slight curvature or bow (also known as "bulge" and "roll"). The point of desired contact of the ball striking face 17 with the golf ball may be considered to be "the sweet spot" 17*a*. For purposes of this disclosure, a line $L_T$ drawn tangent to the surface of the striking face 17 at the sweet spot 17*a* defines a direction parallel to the ball striking face 17. The family of lines drawn tangent to the surface of the striking face 17 at the sweet spot 17*a* defines a striking face plane 17*b*. Line $L_P$ defines a direction perpendicular to the striking face plane 17*b*. Further, the ball striking face 17 may generally be provided with a loft angle $\alpha$, such that at the moment of impact (or at the address position) the ball striking plane 17*b* is not perpendicular to the ground. Generally, the loft angle $\alpha$ is meant to affect the initial upward trajectory of the golf ball at the moment of impact. Rotating the line $L_P$ drawn perpendicular to the striking face plane 17*b* through the negative of the loft angle $\alpha$ defines the desired club-head-trajectory $T_0$ at the moment of impact. Generally, this moment-of-impact club-head-trajectory direction $T_0$ is perpendicular to the longitudinal axis of the club shaft 12. Even further, the line $L_T$, when drawn parallel to the ground, is generally coincident with a direction perpendicular $P_0$ to the moment-of-impact club-head-trajectory direction $T_0$. The term "rearwardly" as used herein generally refers to a direction opposite to the moment-of-impact club-head trajectory direction $T_0$.

The crown region 18, which is located on the upper side of the club head 14, extends from the ball striking face 17 back toward the rear region 22 of the golf club head 14. Further the crown region 18 extends across the width of the club head 14, from the heel region 24 to the toe region 20. When the club head 14 is viewed from below, in a direction that is generally perpendicular to both the $T_0$ and the $P_0$ directions, the crown region 18 cannot be seen.

Referring also to FIG. 2, the sole region 28, which is located on the lower or ground side of the club head 14 opposite to the crown region 18, extends from the ball striking face 17 back toward the rear region 22. As with the crown region 18, the sole region 28 extends across the width of the club head 14, from the heel region 24 to the toe region 20. Referring back to FIG. 1B, when the club head 14 is viewed from above, in a direction that is generally perpendicular to both the $T_0$ and the $P_0$ directions, the sole region 28 cannot be seen.

Referring now also to FIG. 3, the rear region 22 is positioned opposite the ball striking face 17, is located between the crown region 18 and the sole region 28, and extends from the heel region 24 to the toe region 20. When the club head 14 is viewed from the front, in a direction that is generally parallel to the $T_0$ direction, the rear region 22 cannot be seen.

The heel region 24 extends from the ball striking face 17 to the rear region 22. Referring back to FIG. 1B, when the club head 14 is viewed from the toe side, in a direction that is generally parallel to the $P_0$ direction, the heel region 24 cannot be seen.

The toe region 20 extends from the ball striking face 17 to the rear region 22 on the side of the club head 14 opposite to the heel 24. When the club head 14 is viewed from the heel side, in a direction that is generally parallel to the $P_0$ direction, the toe region 20 cannot be seen.

Figure 1B:
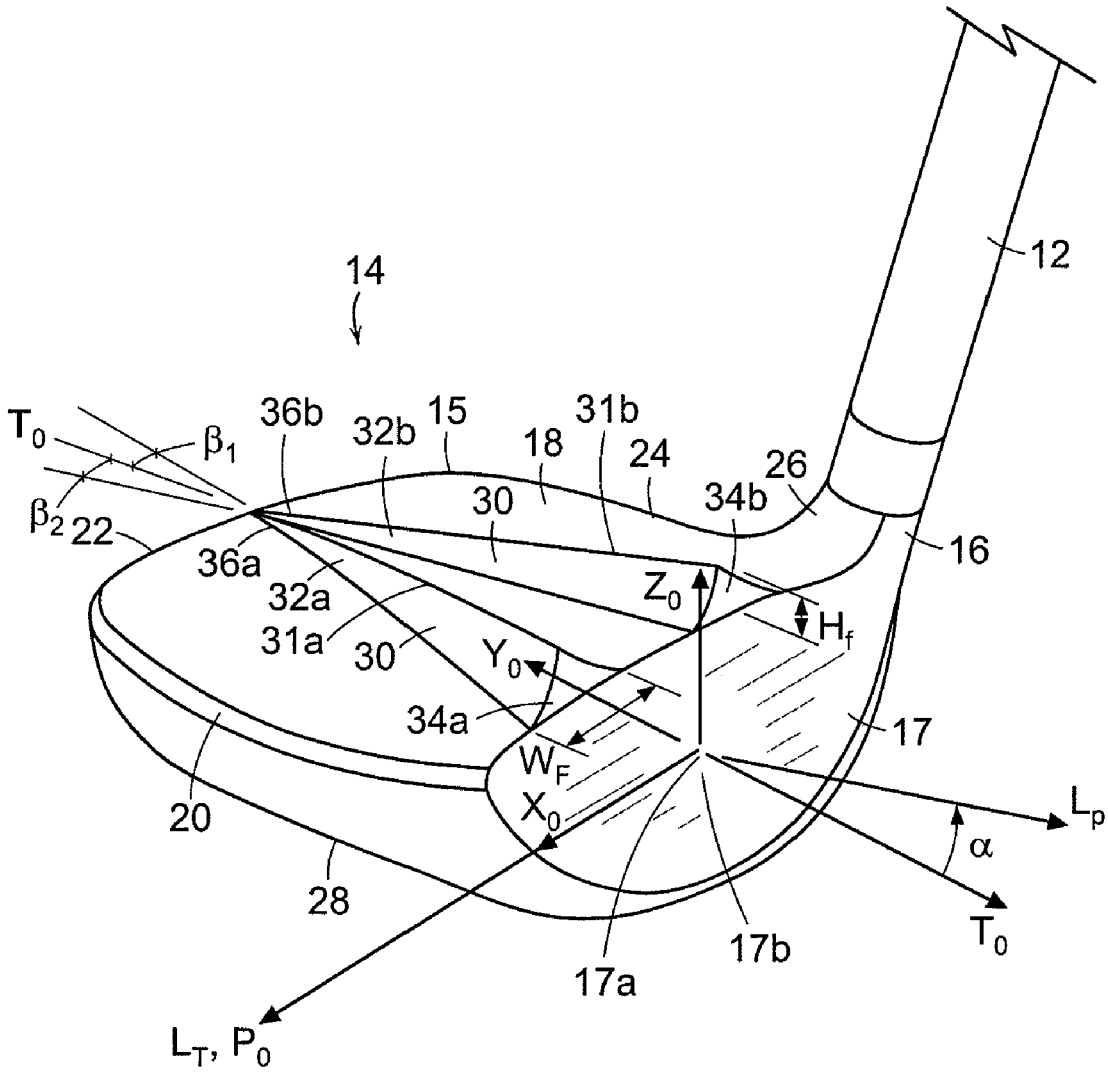
FIG. 1B is an enlarged perspective view of the club head of FIG. 1A.

The hosel 16 is located within the hosel region 26. Referring to FIGS. 1B and 3, the hosel region 26 is located at the intersection of the ball striking face 17, the heel region 24, the crown region 18 and the sole region 28 and may encompass those portions of the heel region 24, the crown region 18 and the sole region 28 that lie adjacent to the hosel 16. Generally, the hosel region 26 includes surfaces that provide a transition from the hosel 16 to the ball striking face 17, the heel region 24, the crown region 18 and/or the sole region 28.

According to certain aspects, as shown in FIGS. 1A and B, the crown region 18 may have a drag-reduction feature 30. The drag-reduction feature 30 may include one or more fins 32. Drag-reduction feature 30 of FIGS. 1A and 1B is configured to channel air flowing over the crown region 18 of the club head 14 generally from the ball striking face 17 toward the rear region 22. Specifically, the drag-reduction feature 30 is configured to channel air flowing between the fins 32 from a wider region in the forward portion of the club head 14 to a narrower region in the rearward portion of the club head 14. As the air within the drag-reduction feature 30 is channeled, it is expected that its speed and energy content will increase. At the same time, it is expected that the air flowing between the fins will be oriented or aligned such that uniform flow occurs substantially in a single direction. Uniform air flow, which may be described as laminar flow, generally reduces aerodynamic drag forces (in contrast to turbulent air flow).

The fins 32 may include a first fin 32*a* and a second fin 32*b*. Each fin 32 includes a uppermost edge 31, which is defined as the line or ridge along the top of the elongated fin 32 where the sides of the fins 32 come together. The uppermost edge 31 may be used to define the orientation of the fin 32. In FIGS. 1A and 1B, the fin 32*a* and its uppermost edge 31*a* are shown as extending in a generally linear fashion, at an angle $\beta_1$ relative to the $T_0$ centerline of the club head 14, from a forward portion of the club head 14 toward a rearward portion of the club head 14. Similarly, the fin 32*b* and its uppermost edge 31*b* are shown as extending in a generally linear fashion, at an angle $\beta_2$ relative to the $T_0$ centerline of the club head 14, from the forward portion of the club head 14 toward a rearward portion of the club head 14. The fins 32 need not extend linearly from the forward portion toward the rearward portion. Thus, in certain aspects, one or more of the fins 32 may be formed in a piecewise linear fashion. In other aspects, one or more of the fins 32, or portions thereof, may be curved.

Angles $\beta_1$ and $\beta_2$ may be equal, but of opposite signs. Alternatively, angles $\beta_1$ and $\beta_2$ need not be equal. According to some aspects, the orientation of the fins 32 (as may be determined from the uppermost edges 31 of the fins 32) may be up to approximately 45 degrees from the centerline $T_0$. Thus, in certain aspects, one or both of the angles $\beta_1$ and $\beta_2$ may range from approximately 1 degree to approximately 45 degrees. In other aspects, the angles $\beta_1$ and $\beta_2$ may range from approximately 5 degrees to approximately 25 degrees or from approximately 5 degrees to approximately 15 degrees. It may be preferred to have the angles $\beta_1$ and $\beta_2$ range from approximately 5 degrees to approximately 10 degrees. Alternatively, it may be preferable to have one or both of the uppermost edges 31 of the fins 32 only very slightly angled, i.e. oriented up to a maximum of only approximately 5 degrees from the centerline $T_0$.

In the particular structure illustrated in FIGS. 1A and 1B, the fins 32 extend from a forward-most end 34 adjacent the ball striking face 17 to a rearward-most end 36 adjacent the rear region 22. As shown in the figures, the uppermost edge 31*a* of the fin 32*a* is spaced apart from the uppermost edge 31*b* of the fin 32*b* at the forward portion of the club head 14 approximately equidistant from the centerline $T_0$ of the club head 14. By way of non-limiting examples, the forward-most ends 34*a*, 34*b* of the uppermost edges 31*a*, 31*b* of the fins 32 may be spaced apart from one another by approximately 20 mm to approximately 70 mm, by approximately 30 mm to approximately 60 mm, or by approximately 25 mm to approximately 50 mm. According to certain embodiments, the forward-most ends 34*a*, 34*b* of the uppermost edges 31*a*, 31*b* of the fins 32*a*, 32*b* need not be positioned equidistant from the centerline $T_0$ of the club head 14.

Also as shown in the figures, the uppermost edges 31 of the fins 32 converge toward each other as they extend toward the rearward portion of the club head 14. According to certain embodiments and as shown, for example, in FIGS. 1A and 1B, the rearward-most ends 36*a*, 36*b* of the uppermost edges 31*a*, 31*b* of the fins 32*a*, 32*b* may be abutted or joined to one another. According to other embodiments, the rearward-most ends 36*a*, 36*b* may be spaced apart from one another. By way of non-limiting examples, the rearward-most ends 36*a*, 36*b* of the uppermost edges 31*a*, 31*b* of the fins 32 may be spaced apart from one another by approximately 2 mm to approximately 25 mm, by approximately 5 mm to approximately 15 mm, or by approximately 5 mm to approximately 10 mm. According to certain embodiments, the rearward-most ends 36*a*, 36*b* of the uppermost edges 31*a*, 31*b* of the fins 32*a*, 32*b* may be positioned equidistant from the centerline $T_0$ of the club head 14. According to even other embodiments, the rearward-most ends 36*a*, 36*b* of the uppermost edges 31*a*, 31*b* of the fins 32*a*, 32*b* may be positioned unequal distances from the centerline $T_0$, and in some example structures, the rearward-most ends 36*a*, 36*b* may both be positioned to the same side of the centerline $T_0$ of the club head 14.

According to certain embodiments and as shown in FIG. 1B, one or more of the fins 32 may extend above the surface of the crown region 18 by a maximum height $H_f$. Typically, the fins 32 may have a maximum height of up to approximately 10 mm. For certain structures, it may be advantageous for the fins 32 to have a maximum height of less than approximately 7 mm, or less than approximately 5 mm, or even less than approximately 3 mm. It may be preferable for the fins 32 to have a maximum height of between approximately 2 mm to approximately 7 mm or, for certain embodiments, to have a maximum height of between approximately 2 mm to approximately 5 mm. By way of non-limiting example, the maximum height of fin 32*a* may be the same as the maximum height of fin 32*b*. Further, the height of the fins 32 may be greatest in the forward portion of the club head 14 and may be least in the rearward portion of the club head 14. Optionally, the height of one or more of the fins 32 may be greatest between the forward-most ends 34 and the rearward-most ends 36. In certain embodiments, the height of the fins 32 may decrease (e.g., linearly decrease) as the fins 32 extend from their forward-most ends 34 to their rearward-most ends 36. Optionally, the height of the fins 32 may be reduced to zero (or substantially zero) in the rear region 22 or at the rearward-most ends 36 of the fins 32.

The cross-section of the fins 32 may be of any suitable shape, although a preferred shape may include a relatively wide base that gradually tapers upward to a slightly rounded uppermost edge 31, as best shown in FIG. 1B. The width $W_F$ of the base of the fins 32 may range from approximately 2 mm up to approximately 10 mm, from approximately 2 mm up to approximately 7 mm, or even from approximately 3 mm to approximately 5 mm. In certain aspects, the cross-sectional shape of the fins 32 may best be described as being substantially triangular in shape. The sides surfaces of the fins 32 may be straight, concavely curved, convexly curved and/or a combination thereof. Providing the fins 32 with concavely curved side surfaces would allow the fins 32 to more smoothly merge into the surface of the crown region 18. Of course, the cross-sectional shape of the fins 32 need not be constant along the length of the fins 32. By way of non-limiting example, the width $W_F$ of the base of the fins 32 may be constant along the length of the fins 32, while the height $H_F$ of the fins 32 may be at a maximum at, or near, the forward-most ends 34 of the fins 32 and thereafter gradually decreasing to zero at the rearward-most ends 36 of the fins 32. As another example, as shown in FIG. 1B, both the height and the width of the fins 32 may decrease as the fins 32 extend toward the rear region 22 of the club head 14.

The forward-most end 34 of the fin 32 may include a surface that is oriented substantially parallel to the ball striking face 17, as shown, for example, in FIG. 1B. Alternatively, the forward-most end surface may be canted or sloped away from the ball striking face 17. Such a sloped surface may provide a smoother, more aerodynamic, transition than a vertically-oriented front surface. As another option, the forward-most end 34 of the fin 32 may include a prow-like feature, i.e., the cross section of the fin 32 may taper down to a relatively thin leading edge. Even further, the forward-most end 34 of the fin 32 may be both tapered to a relatively thin leading edge and sloped away from the ball striking face. Additionally, the forward-most end 34 of the fin 32 need not extend all the way to the ball striking face 17. By way of non-limiting examples, the forward-most end 34 of the fin 32 may be positioned up to approximately 2 mm, up to approximately 5 mm, or even up to approximately 10 mm away from the ball striking face 17. Further, for purposes of this measurement, where the ball striking face 17 and the crown region 18 transition from one to the other the ball striking face 17 includes the surface that is more vertical than horizontal and the crown region 18 includes the surface that is more horizontal than vertical, when the club 10 is in the address position.

As discussed above, the rearward-most end 36 of the fin 32 may smoothly and tangentially merge into the surface of the crown region 18. In other words, the height of the fin 32 may gradually decrease to zero at the rearward-most end 36. Alternatively, the rearward-most end 36 of the fin 32 may project above the surface, such that a more abrupt end of the fin 32 is provided. In such case, according to certain embodiments, the thickness of the rearward-most end 36 may taper down to a relatively thin trailing edge. Additionally, the rearward-most end 36 of the fin 32 need not extend all the way to the rear region 22 of the club head 14. By way of non-limiting examples, the rearward-most end 36 of the fin 32 may be positioned up to approximately 2 mm, up to approximately 5 mm, up to approximately 10 mm, or even up to approximately 20 mm away from the rear region 22. For purposes of this measurement, where the rear region 22 and the crown region 18 transition from one to the other the rear region 22 includes the surface that is more vertical than horizontal and the crown region 18 includes the surface that is more horizontal than vertical, when the club 10 is in the address position.

Figure 6A:
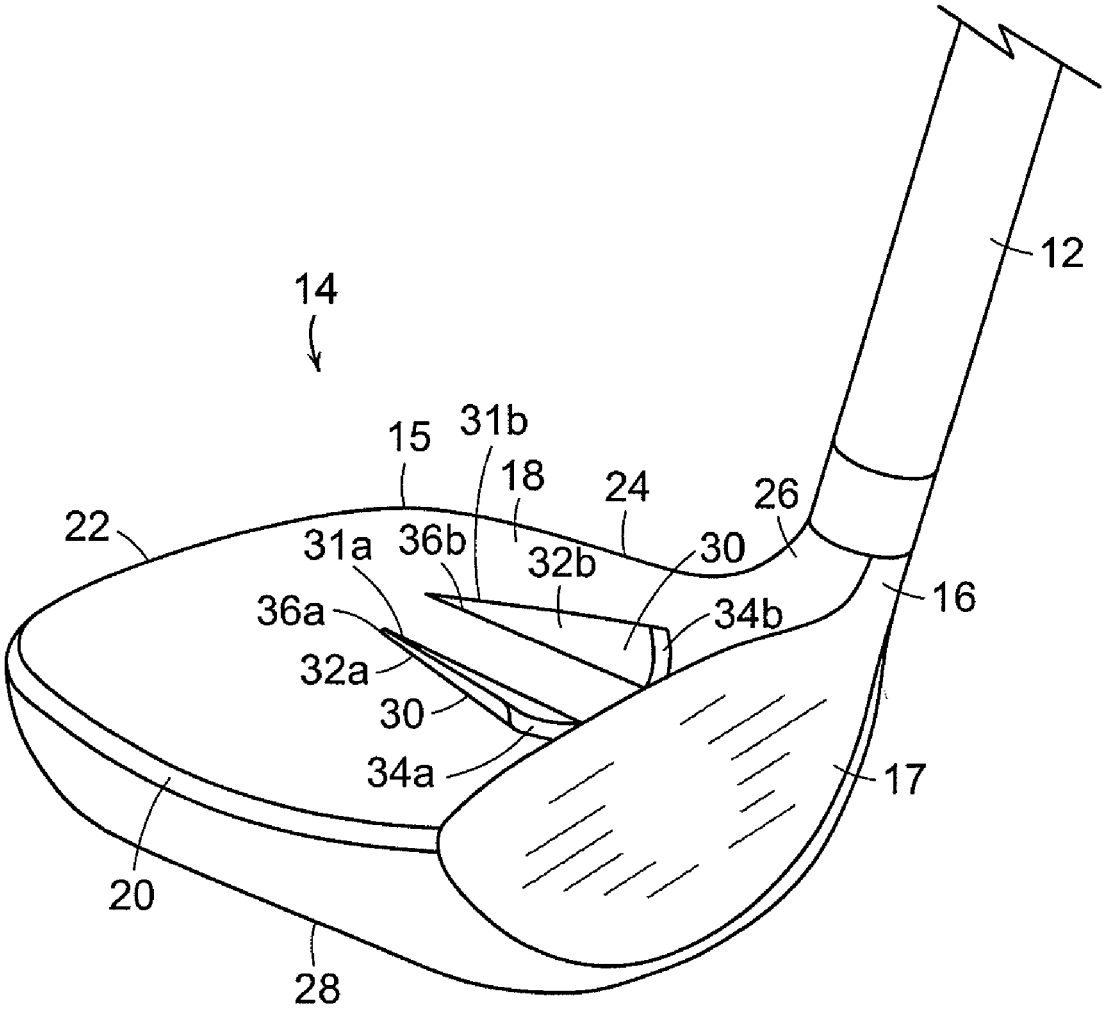
FIGS. 6A, 6B, 6C, 6D, 6E and 6F illustrate certain features of alternative drag-reduction structures according to other illustrative aspects.
Figure 6B:
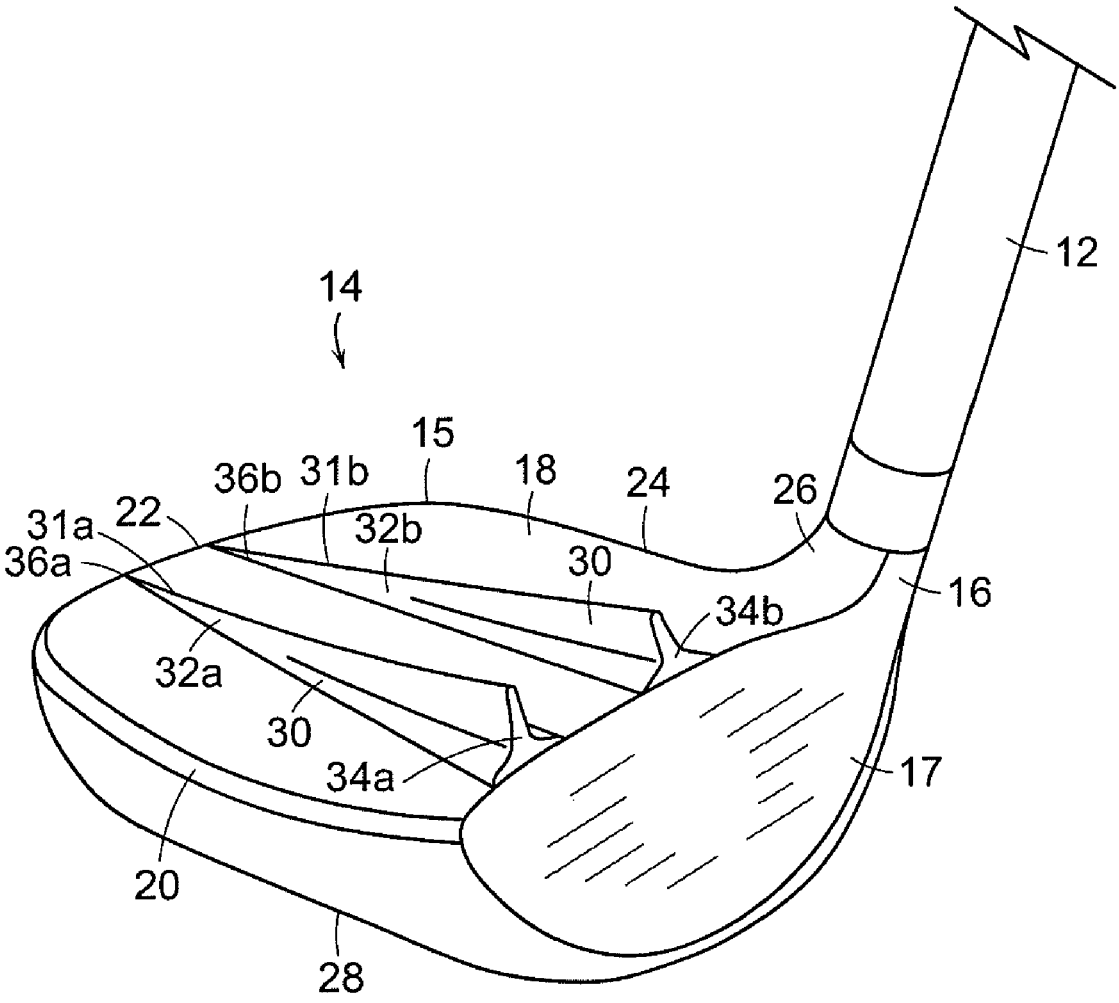
Figure 6C:
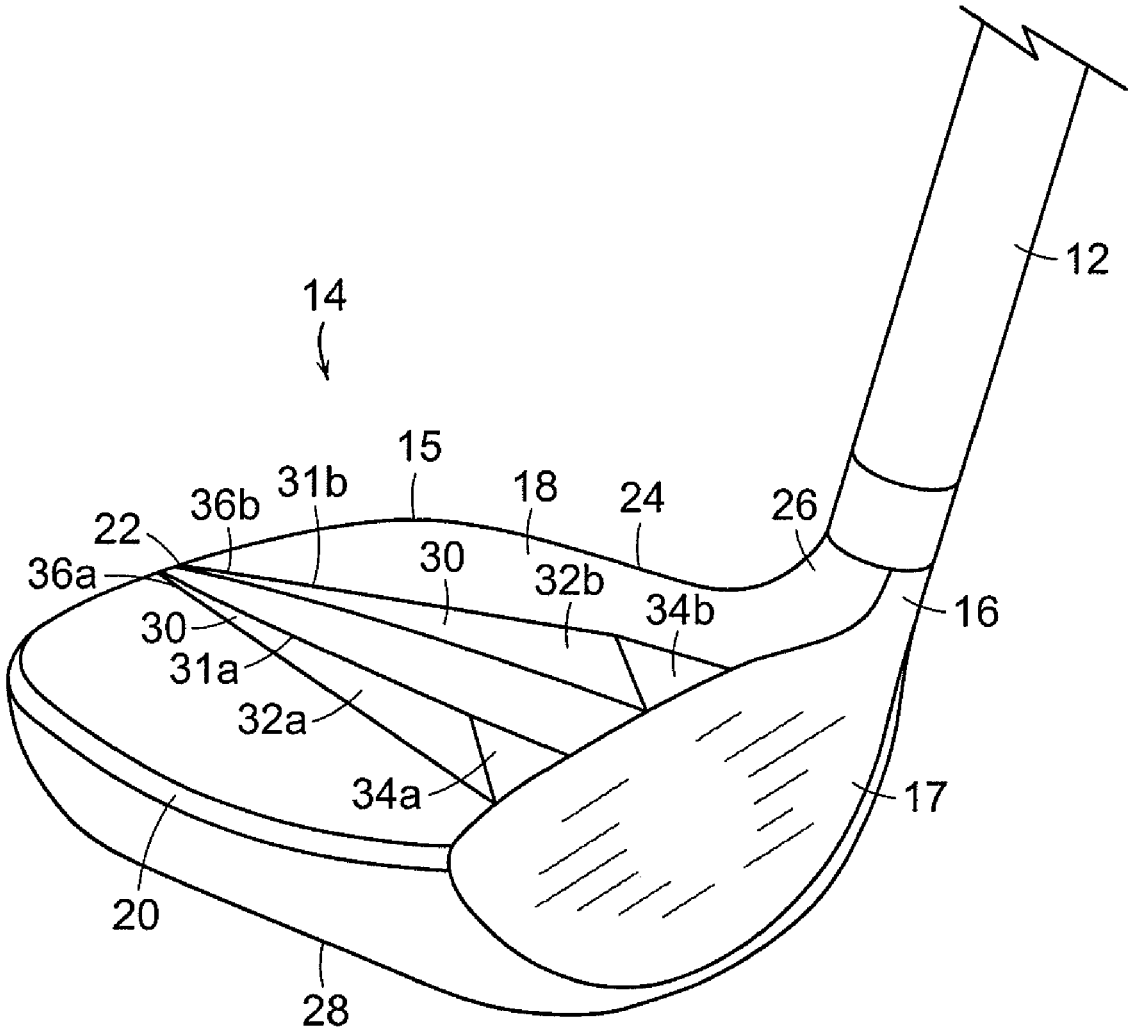
Figure 6D:
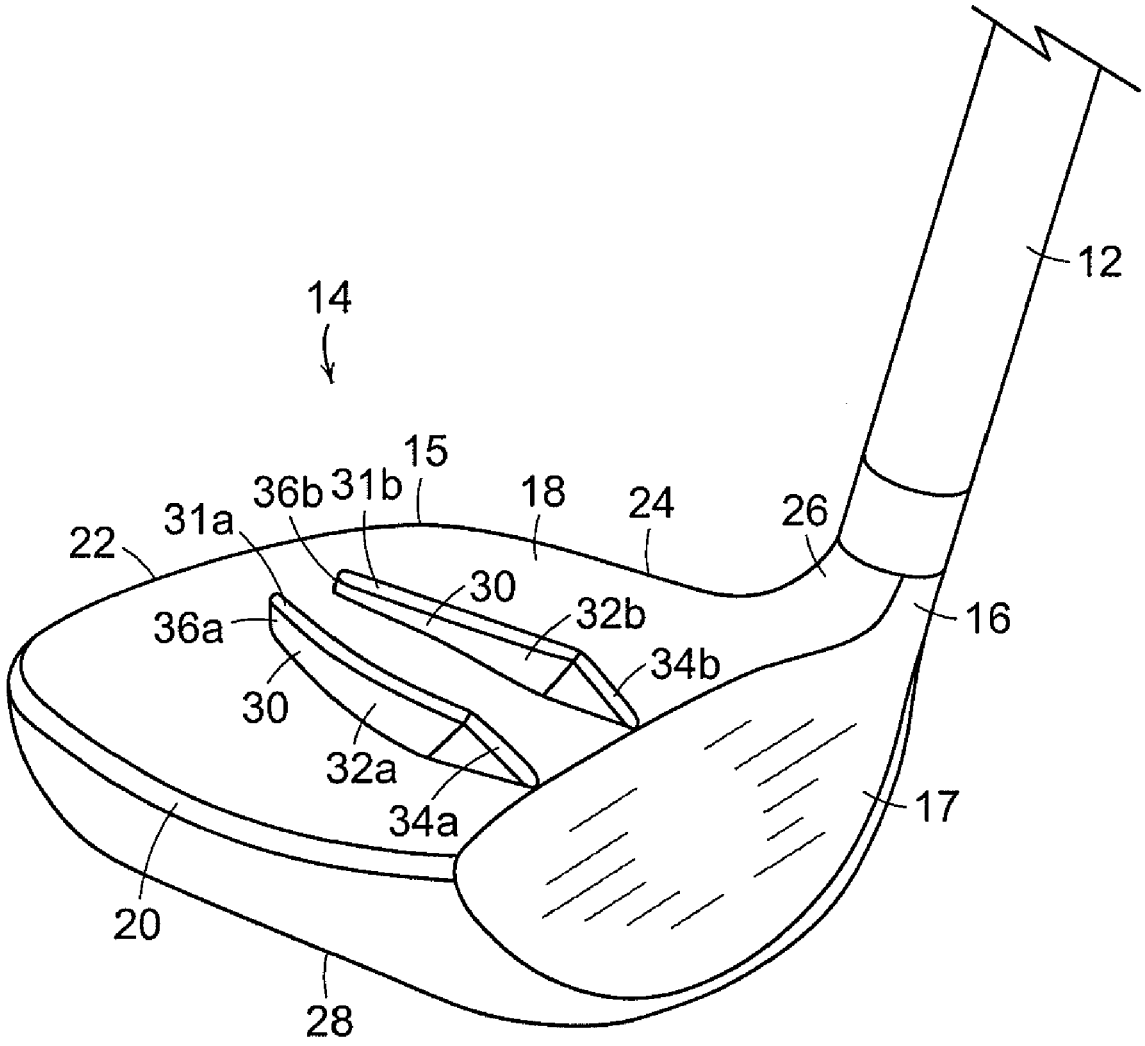
Figure 6E:
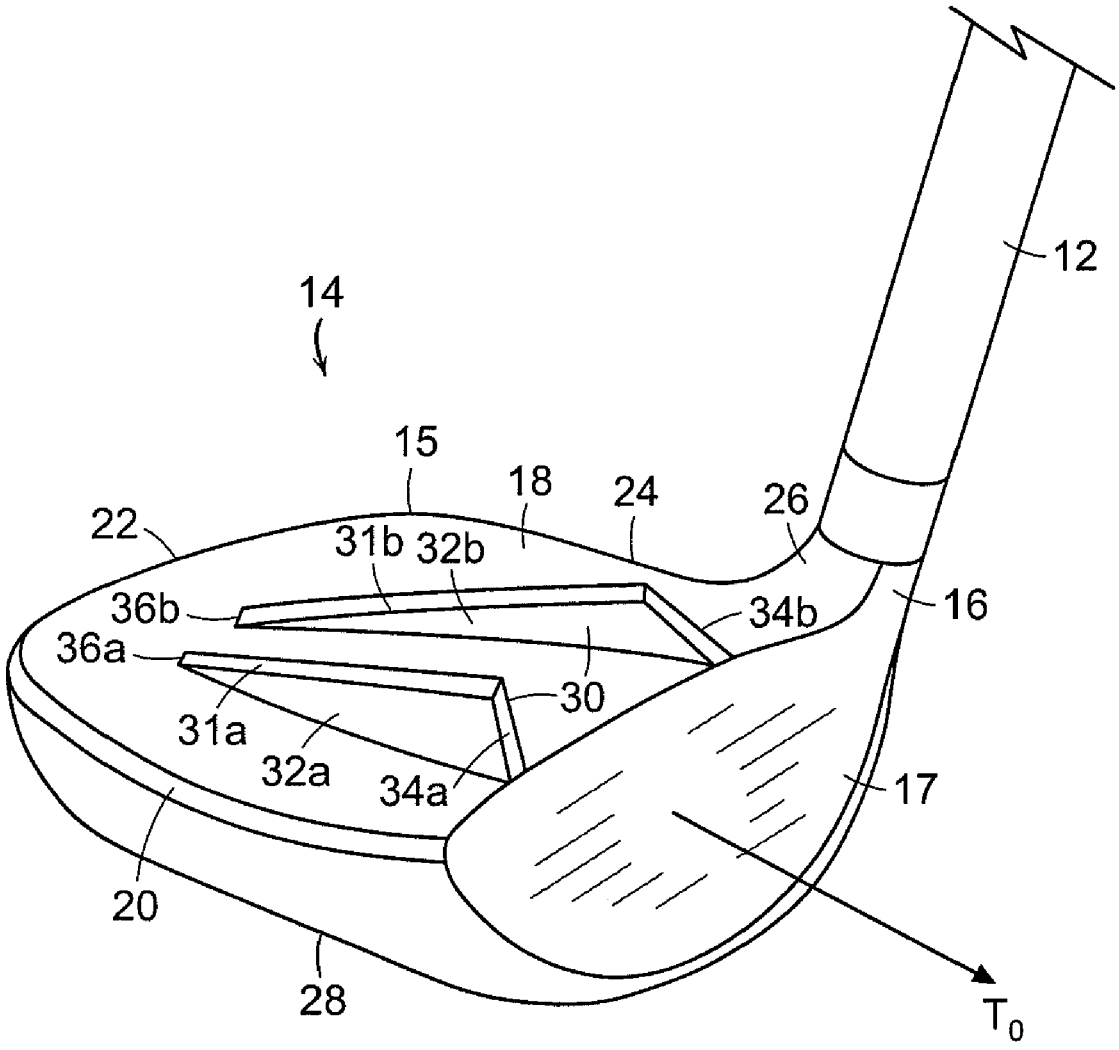
Figure 6F:
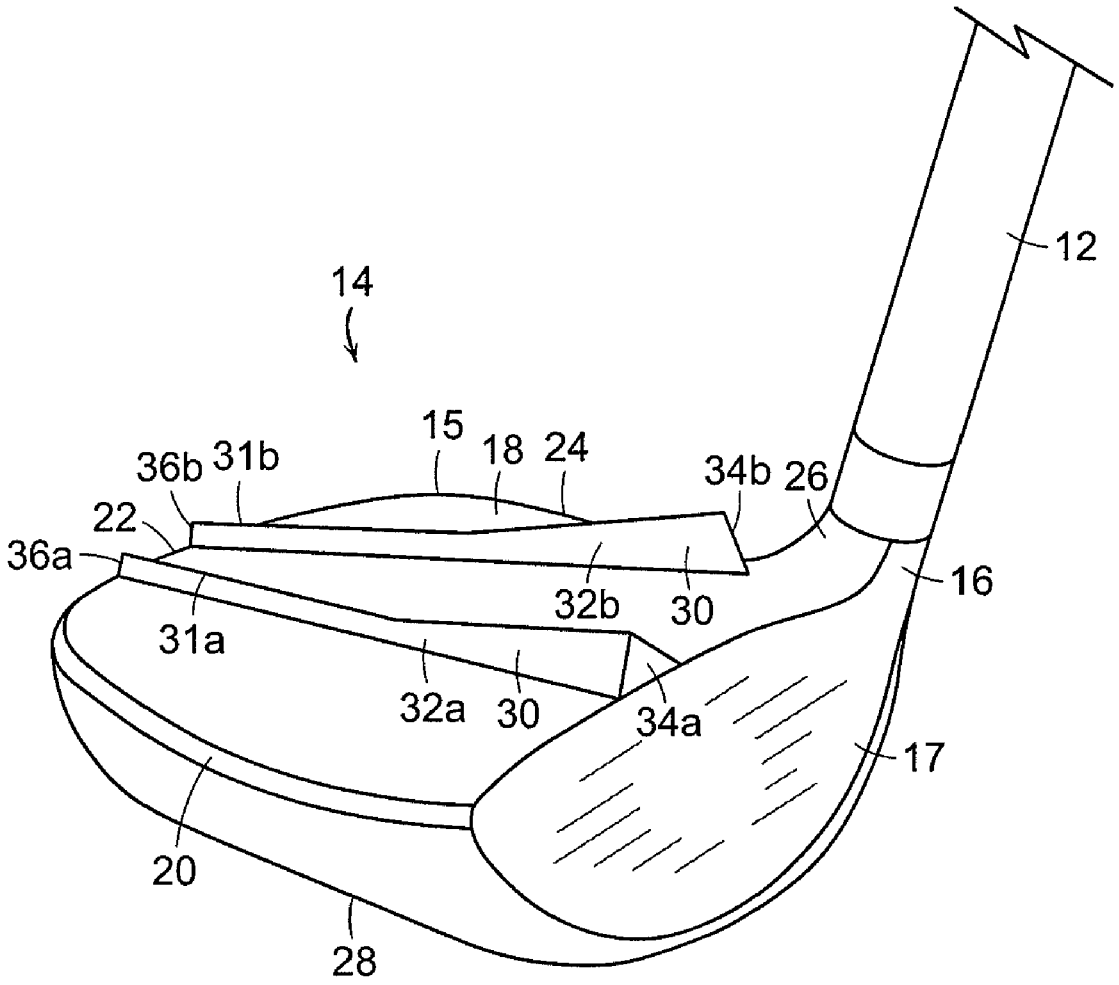

Non-limiting examples of alternative embodiments of drag-reduction feature 30, having certain characteristics, as discussed above, are shown in FIGS. 6A, 6B, 6C, 6D, 6E and 6F. FIG. 6A illustrates the fins 32 each having a substantially rectangular cross-section and canted at an angle away from the centerline of the club head 14. The fins 32 of FIG. 6A extend from the ball striking face 17 to just beyond the front-to-rear midpoint of the club head 14. FIG. 6B illustrates the fins 32 having an irregularly shaped cross section with generally concave side surfaces. The fins 32 of FIG. 6B extend from the ball striking face 17 to the rear region 22 with linearly decreasing height and width. The angle each fin 32 makes with the centerline of the club head 14 is less than 5 degrees in this embodiment. FIG. 6C illustrates the fins 32 having a front surface that is angled away from the ball striking face 17. FIG. 6D illustrates the fins 32 having a prow-like feature at their forward-most ends 34. The fin 32*a* in FIG. 6D is curved, while the fin 32*b* is linear. Further, the fins 32 in FIG. 6D do not merge smoothly into the surface of the crown region at their rearward-most ends 36. FIG. 6E illustrates the drag-reduction feature 30 oriented at an angle from the centerline $T_0$. Even further, FIG. 6E illustrates that the fins 32 each have a substantially rectangular cross-section and are canted at an angle toward each other. Additionally, the rearward-most ends 36 of the fins 32 are both located to the toe side of the centerline $T_0$ of the club head 14. FIG. 6F illustrates that the forward-most end 34 of the fins 32 need not necessarily be positioned on or adjacent to the ball-striking face 17. In this example embodiment, the forward-most end 34*b* of fin 32*b* is positioned in the hosel region 26 of the club head 14, while the forward-most end 34*a* of fin 32*a* is positioned adjacent the ball-striking face 17. FIG. 6F also illustrates that the rearward-most ends 36*a*, 36*b* of the fins 32*a*, 32*b* are positioned at the rear region 22 and further that the rearward-most ends 36 do not merge smoothly into the surface of the crown region 18, but extend above the surface. Additionally, FIG. 6F also illustrates that the uppermost edge 31 of the fins 32 is bi-linear, and that the height of each of the fins 32 is relatively constant over the rearward portions of the fins 32.

Figure 7:
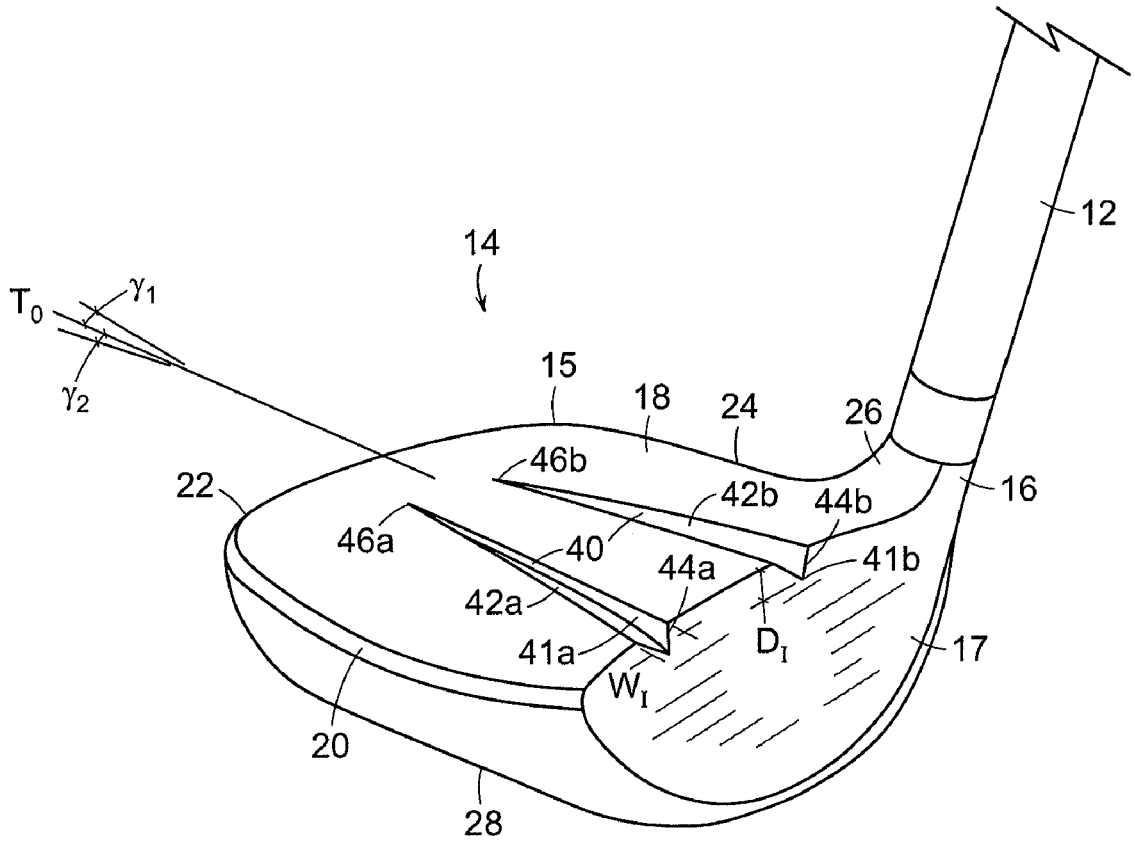
FIG. 7 is a perspective view of a club head, generally showing the ball striking face, the crown region and the toe region of the club head, with at least one drag-reducing structure included on a surface of the club head according to a further illustrative aspect.

According to other aspects, as shown in FIG. 7, the crown region 18 may have an alternative drag-reduction feature 40. The drag-reduction feature 40 may include one or more elongated indentations 42 generally oriented from the front toward the rear of the club head 14. The drag-reduction feature 40 is also configured to channel air flowing over the crown region 18 of the club head 14 generally from the ball striking face 17 toward the rear region 22. It is expected that the indentations, themselves, may channel air flowing over the club head to follow the elongated axis of the indentations. Further, this channeled air flow may act as a virtual fin, such that air flowing over the club head between the indentations 42 may be channeled by the air flowing down the longitudinal length of the indentations.

The indentations 42 may include a first indentation 42*a* and a second indentation 42*b*. Each indentation 42 may include a lowermost contour 41, which is defined as the deepest part of the indentation 42 along the elongated length of the indentation. The indentation 42*a* and its lowermost contour 41*a* are shown as extending in a generally linear fashion, at an angle $\gamma_1$ relative to the $T_0$ centerline of the club head 14, from a forward portion of the club head 14 toward a rearward portion of the club head 14. Similarly, the indentation 42*b* and its lowermost contour 41*b* are shown as extending in a generally linear fashion, at an angle $\gamma_2$ relative to the $T_0$ centerline of the club head 14, from the forward portion of the club head 14 toward a rearward portion of the club head 14. The indentations 42 or their lowermost contours 41 need not extend linearly from the forward portion toward the rearward portion. Thus, in certain aspects, one or more of the indentations 42 may be formed in a piecewise linear fashion. In other aspects, one or more of the indentations 42, or portions thereof, may be curved.

Angles $\gamma_1$ and $\gamma_2$ may be equal, but of opposite signs. Alternatively, angles $\gamma_1$ and $\gamma_2$ need not be equal. According to some aspects, the indentations 42 and their lowermost contours 41 may be oriented up to 45 degrees from the centerline $T_0$. Thus, in certain aspects, one or both of the angles $\gamma_1$ and $\gamma_2$ may range from approximately 1 degree to approximately 45 degrees. In other aspects, the angles $\gamma_1$ and $\gamma_2$ may range from approximately 5 degrees to approximately 25 degrees or from approximately 5 degrees to approximately 15 degrees. It may be preferred to have the relatively shallow angles $\gamma_1$ and $\gamma_2$ that range from approximately 5 degrees to approximately 10 degrees. Alternatively, it may be preferable to have one or both of the indentations 42 only very slightly angled, i.e. oriented up to a maximum of only approximately 5 degrees from the centerline $T_0$.

In the particular structure illustrated in FIG. 7, the lowermost contours 41 of the indentations 42 extend from a forward-most end 34 at the ball striking face 17 to a rearward-most end 36 a certain distance from the rear region 22. As shown in the figures, the lowermost contour 41*a* of the indentation 42*a* is spaced apart from the lowermost contour 41*b* of the indentation 42*b* at the forward portion of the club head 14 approximately equidistant from the centerline $T_0$ of the club head 14. By way of non-limiting examples, the forward-most ends 44*a*, 44*b* of the lowermost contours 41*a*, 41*b* of the indentations 42 may be spaced apart from one another by approximately 20 mm to approximately 70 mm, by approximately 30 mm to approximately 60 mm, or by approximately 25 mm to approximately 50 mm. According to certain embodiments, the forward-most ends 44*a*, 44*b* of the lowermost contours 41*a*, 41*b* of the indentations 42*a*, 42*b* need not be positioned equidistant from the centerline $T_0$ of the club head 14.

Also as shown in FIG. 7, the lowermost contours 41 of the indentations 42 converge toward each other as they extend toward the rearward portion of the club head 14. According to certain embodiments, the rearward-most ends 46*a*, 46*b* of the lowermost contours 41*a*, 41*b* of the indentations 42*a*, 42*b* may be abutted or joined to one another. According to other embodiments, and as shown in FIG. 7, the rearward-most ends 46*a*, 46*b* may be spaced apart from one another. By way of non-limiting examples, the rearward-most ends 46*a*, 46*b* of the lowermost contours 41*a*, 41*b* of the indentations 42 may be spaced apart from one another by up to approximately 25 mm, by approximately 5 mm to approximately 15 mm, or by approximately 5 mm to approximately 10 mm. According to certain embodiments, the rearward-most ends 46*a*, 46*b* of the lowermost contours 41*a*, 41*b* of the indentations 42*a*, 42*b* may be positioned equidistant from the centerline $T_0$ of the club head 14. According to even other embodiments, the rearward-most ends 46*a*, 46*b* of the lowermost contours 41*a*, 41*b* of the indentations 42*a*, 42*b* may be positioned different distances from the centerline $T_0$, and in some example structures, the rearward-most ends 46*a*, 46*b* may both be positioned to the same side of the centerline $T_0$.

According to certain embodiments, the indentations 42 may extend below the surface of the crown region 18 by a depth $D_I$. Typically, the indentations 42 may have a maximum depth of up to approximately 10 mm. For certain structures, it may be advantageous for the indentations 42 to have a maximum depth of less than approximately 7 mm, or less than approximately 5 mm, or even less than approximately 3 mm. It may be preferable for the indentations 42 to have a maximum depth of between approximately 2 mm to approximately 7 mm or, for certain embodiments, to have a maximum depth of between approximately 2 mm to approximately 5 mm. The depth of indentation 42*a* may be the same as the depth of indentation 42*b*. Further, the depth of the indentations 42 may be greatest in the forward portion of the club head 14 and may be least in the rearward portion of the club head 14. In certain embodiments, the depth of the indentations 42 may decrease (e.g., linearly decrease) as the indentations 42 extend from the forward region to the rearward region of the club head 14. Optionally, the depth of the indentations 42 may be reduced to zero in the rear region 22 or at the rearward-most end 46 of the indentations 42.

The cross-section of the indentations 42 may be of any suitable shape, although a preferred shape may include a relatively wide opening that tapers downward to a slightly rounded edge, as best shown in FIG. 7. The width $W_I$ of the opening of the indentations 42 may range from approximately 2 mm up to approximately 10 mm, from approximately 2 mm up to approximately 7 mm, or even from approximately 3 mm to approximately 5 mm. In certain aspects, the cross-sectional shape of the indentations 42 may best be described as being substantially triangular in shape. The side surfaces of the indentations 42 may be straight and/or curved. Providing the indentations 42 with convexly curved side surfaces would allow the indentations 42 to more smoothly merge into the surface of the crown region 18. Of course, the cross-sectional shape of the indentations 42 need not be constant along the length of the indentations 42. By way of non-limiting example, the width $W_1$ of the opening of the indentations 42 may be constant along the length of the indentations 42, while the depth $D_I$ of the indentations 42 may be at a maximum at, or near, the forward-most ends 44 of the indentations 42 and thereafter gradually decreasing to zero at the rearward-most ends 46 of the indentations 42.

The forward-most ends 44 of the indentations 42 may be open, i.e., they may extend all the way to the ball striking face 17, for example, as shown in FIG. 7. Alternatively, the forward-most ends 44 of the indentations may be closed and may include a surface that is oriented substantially parallel to the ball striking face 17. Optionally, the forward-most end surface may be canted or sloped away from the ball striking face 17. Such a sloped surface may provide a smoother, more aerodynamic, transition from the crown region 18 to the indentations 42. As another option, the forward-most end 44 of one or more of the indentations 42 may be tapered, i.e., the cross section of the indentation 42 may taper down to a relatively thin line. Even further, the forward-most end 44 of the indentation 42 may be both tapered to a relatively thin line and sloped away from the ball striking face 17. By way of non-limiting examples, the forward-most end 44 of one or more of the indentations 42 may be positioned up to approximately 2 mm, up to approximately 5 mm, or even up to approximately 10 mm away from the ball striking face 17. For purposes of this measurement, where the ball striking face 17 and the crown region 18 transition from one to the other, the ball striking face 17 includes the surface that is more vertical than horizontal and the crown region 18 includes the surface that is more horizontal than vertical, when the club 10 is in the address position.

As discussed above, the rearward-most end 46 of the indentation 42 may smoothly and tangentially merge into the surface of the crown region 18. In other words, the depth of the indentation 42 may gradually decrease to zero at the rearward-most end 46. Alternatively, the rearward-most end 46 of the indentation 42 may extend below the surface, such that a more abrupt end of the indentation 42 is provided. In such case, according to certain embodiments, the rearward-most end 46 may taper up to a relatively thin trailing edge. Additionally, as shown in FIG. 7, the rearward-most end 46 of the indentation 42 need not extend all the way to the rear region 22 of the club head 14. By way of non-limiting examples, the rearward-most end 46 of the indentation 42 may be positioned up to approximately 2 mm, up to approximately 5 mm, up to approximately 10 mm, or even up to approximately 20 mm away from the rear region 22. For purposes of this measurement, where the rear region 22 and the crown region 18 transition from one to the other, the rear region 22 includes the surface that is more vertical than horizontal and the crown region 18 includes the surface that is more horizontal than vertical, when the club 10 is in the address position.

Indented drag-reduction features on the crown portion also may take on other orientations, shapes and/or characteristics, e.g., akin to the variations in the raised fin constructions shown in FIGS. 6A through 6F.

Figure 8:
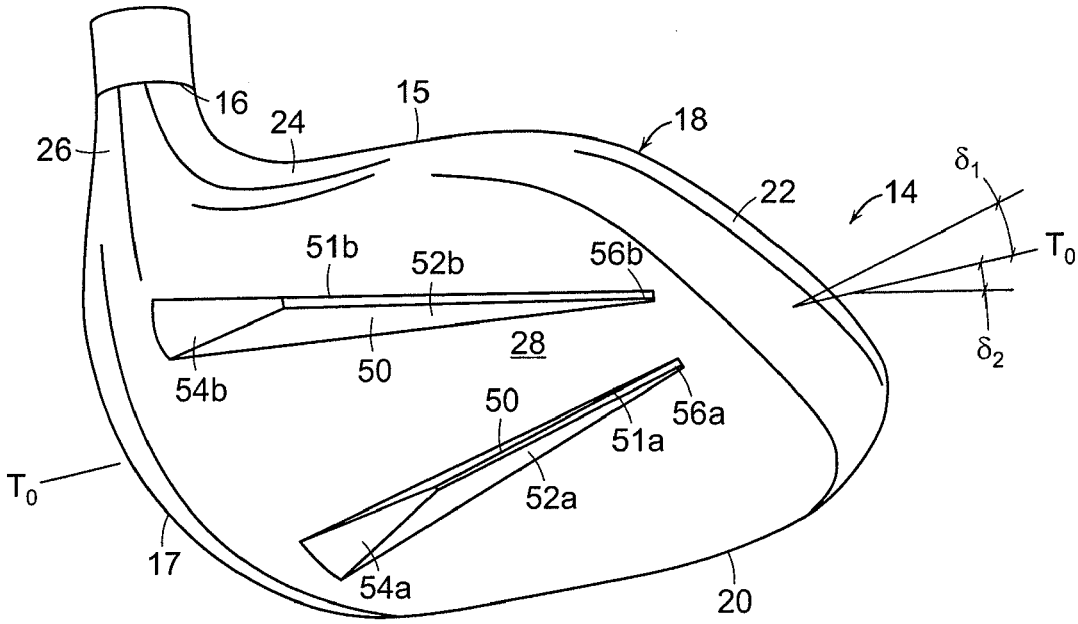
FIG. 8 is a perspective view of a club head, generally showing the sole region, the heel region and the rear portion of the club head, with at least one drag-reducing structure included on a surface of the club head according to another illustrative aspect.

According to other aspects, as shown in FIG. 8, the sole region 28 may have a drag-reduction feature 50. The drag-reduction feature 50 may include one or more fins 52. Drag-reduction feature 50 is configured to channel air flowing over the sole region 28 of the club head 14 generally from the ball striking face 17 toward the rear region 22. Specifically, the drag-reduction feature 50 is configured to channel air flowing between the fins 52 from a wider region in the forward portion of the club head 14 to a narrower region in the rearward portion of the club head 14. It is expected that this channeling action may increase the velocity of the air flowing over the sole region 28 within the drag-reduction feature 50 while at the same time aligning the air flow and maintaining a uniform, laminar flow.

The fins 52 may include a first fin 52*a* and a second fin 52*b*. Each fin 52*a*, 52*b* may include a ridge or uppermost edge 51*a*, 51*b* that extends down the length of the fin. The fin 52*a* and its uppermost edge 51*a* are shown in FIG. 8 as extending in a generally linear fashion at an angle $\delta_1$ relative to the $T_0$ centerline of the club head 14, from a forward portion of the club head 14 toward a rearward portion of the club head 14. Similarly, the fin 52*b* and its uppermost edge 51*b* are shown as extending in a generally linear fashion at an angle $\delta_2$ relative to the $T_0$ centerline of the club head 14, from the forward portion of the club head 14 toward a rearward portion of the club head 14. The fins 52 may be slightly curved as they extend from the forward portion toward the rearward portion of the club head 14. In certain aspects, one or more of the fins 52 may be formed in linear or a piecewise linear fashion.

In FIG. 8, angles $\delta_1$ and $\delta_2$ are unequal, with the magnitude of angle $\delta_1$ being greater than that of angle $\delta_2$. Alternatively, the magnitude of the angles $\delta_1$ and $\delta_2$ may be equal. According to some aspects, the fins 52 may be oriented up to approximately 45 degrees from the centerline $T_0$. Thus, in certain aspects, one or both of the angles $\delta_1$ and $\delta_2$ may range up to approximately 45 degrees. In other aspects, the angles $\delta_1$ and $\delta_2$ may range from approximately 5 degrees to approximately 25 degrees or from approximately 5 degrees to approximately 15 degrees. It may be preferred to have the angles $\delta_1$ and $\delta_2$ range from approximately 5 degrees to approximately 10 degrees. Alternatively, it may be preferable, especially for fins 52 which are located on the surface of the sole region 28, to have one or more of the fins 52 only very slightly angled, i.e. oriented up to a maximum of only approximately 5 degrees from the centerline $T_0$.

In the particular structure illustrated in FIG. 8, the fins 52 extend from a forward-most end 54 generally adjacent the ball striking face 17 to a rearward-most end 56 generally adjacent the rear region 22. As shown in FIG. 8, the uppermost edge 51*a* of the fin 52*a* is spaced apart from the uppermost edge 51*b* of the fin 52*b* at the forward portion of the club head 14 unequal distances from the centerline $T_0$ of the club head 14—the forward-most end 54*b* of the uppermost edge 51*b* of the fin 52*b* is closer to the centerline $T_0$ than the forward-most end 54*a* of the uppermost edge 51*a* of the fin 52*a*. By way of non-limiting examples, the forward-most ends 54*a*, 54*b* of the fins 32 may be spaced apart from one another by approximately 20 mm to approximately 70 mm, by approximately 30 mm to approximately 60 mm, or by approximately 25 mm to approximately 50 mm. According to certain embodiments, the forward-most ends 54*a*, 54*b* of the uppermost edges 51*a*, 51*b* of the fins 52*a*, 52*b* may be positioned equidistant from the centerline $T_0$ of the club head 14.

Also as shown in FIG. 8, the fins 52 converge toward each other as they extend toward the rearward portion of the club head 14. According to certain embodiments, the rearward-most ends 56*a*, 56*b* of the uppermost edges 51*a*, 51*b* of the fins 52*a*, 52*b* may be abutted or joined to one another. According to other embodiments, and as shown in FIG. 8, the rearward-most ends 56*a*, 56*b* may be spaced apart from one another. By way of non-limiting examples, the rearward-most ends 56*a*, 56*b* of the uppermost edges 51*a*, 51*b* of the fins 52 may be spaced apart from one another by approximately 2 mm to approximately 25 mm, by approximately 5 mm to approximately 15 mm, or by approximately 5 mm to approximately 10 mm. According to certain embodiments, the rearward-most ends 56*a*, 56*b* of the uppermost edges 51*a*, 52*a* of the fins 52*a*, 52*b* may be positioned equidistant from the centerline $T_0$ of the club head 14. According to even other embodiments, the rearward-most ends 56*a*, 56*b* of the uppermost edges 51*a*, 51*b* of the fins 52 may be positioned unequal distances from the centerline $T_0$, and in some example structures, the rearward-most ends 56*a*, 56*b* may both be positioned to the same side of the centerline $T_0$.

According to other embodiments, the fins 52 may extend beyond the surface of the sole region 28 by a height. Typically, the fins 52 may have a maximum height of up to approximately 5 mm. For certain structures, it may be advantageous for the fins 52 to have a maximum height of less than approximately 3 mm, or less than approximately 1 mm, or even less than approximately 1 mm. It may be preferable for the fins 52 to have a maximum height of between approximately 2 mm to approximately 5 mm or, for certain embodiments, to have a maximum height of between approximately 2 mm to approximately 3 mm. The height of fin 52*a* may be the same as the height of fin 52*b*. Further, the height of the fins 52 may be greatest in the forward portion of the club head 14 and may be least in the rearward portion of the club head 14. In certain embodiments, the height of the fins 52 may decrease (e.g., linearly decrease) as the fins 52 extend from the forward region to the rearward region of the club head 14. Optionally, the height of the fins 52 may be reduced to zero in the rear region 22 or at the rearward-most end 56 of the fins 52.

As with the fins 32 on the crown region 18, the cross-section of the fins 52 may be of any suitable shape, although a preferred shape may include a relatively wide base that tapers away from the surface of the sole region 28 to a slightly rounded edge, as best shown in FIG. 8. The width of the base of the fins 52 may range from approximately 2 mm up to approximately 10 mm, from approximately 2 mm up to approximately 7 mm, or even from approximately 3 mm to approximately 5 mm. In certain aspects, the cross-sectional shape of the fins 52 may best be described as being substantially triangular in shape. The side surfaces of the triangle may be straight or curved. Providing the fins 52 with concavely curved side surfaces would allow the fins 52 to more smoothly merge into the surface of the sole region 28. Of course, the cross-sectional shape of the fins 52 need not be constant along the length of the fins 52. By way of non-limiting example, the width of the base of the fins 52 may be constant along the length of the fins 52, while the height of the fins 52 may be at a maximum at, or near, the forward-most ends 54 of the fins 52 and thereafter gradually decreasing to zero at the rearward-most ends 56 of the fins 52.

Although the forward-most end 54 of the fin 52 may include a surface that is oriented substantially parallel to the ball striking face 17, a preferred embodiment may include a forward-most end surface that is canted or sloped away from the ball striking face 17 as shown in FIG. 8. Such a sloped surface may provide a smoother, more aerodynamic, transition from the surface of the sole region 28. As another option, the forward-most end 54 of the fin 52 may include a prow-like feature, i.e., the cross section of the fin 52 may taper down to a relatively thin leading edge. Even further, the forward-most end 54 of the fin 52 may be both tapered to a relatively thin leading edge and sloped away from the ball striking face. Additionally, as shown in FIG. 8, the forward-most end 54 of the fin 52 need not extend all the way to the ball striking face 17. By way of non-limiting examples, the forward-most end 54 of the fin 52 may be positioned up to approximately 2 mm, up to approximately 5 mm, or even up to approximately 10 mm away from the ball striking face 17. For purposes of this measurement, where the ball striking face 17 and the sole region 28 transition from one to the other, the ball striking face 17 includes the surface that is more vertical than horizontal and the sole region 28 includes the surface that is more horizontal than vertical, when the club 10 is in the address position.

The rearward-most end 56 of the fin 52 may smoothly and tangentially merge into the surface of the sole region 28 as is shown in FIG. 8. In other words, the height of the fin 52 may gradually decrease to zero at the rearward-most end 56. Alternatively, the rearward-most end 56 of the fin 52 may project above the surface of the sole region 28, such that a more abrupt end of the fin 52 is provided. In such case, according to certain embodiments, the rearward-most end 56 may taper down to a relatively thin trailing edge. Additionally, as is also shown in FIG. 8, the rearward-most end 56 of the fin 52 need not extend all the way to the rear region 22 of the club head 14. By way of non-limiting examples, the rearward-most end 56 of the fin 52 may be positioned up to approximately 2 mm, up to approximately 5 mm, up to approximately 10 mm, or even up to approximately 20 mm away from the rear region 22. For purposes of this measurement, where the rear region 22 and the sole region 28 transition from one to the other, the rear region 22 includes the surface that is more vertical than horizontal and the sole region 28 includes the surface that is more horizontal than vertical, when the club 10 is in the address position.

The fin-like drag-reduction features on the sole portion like those shown in FIG. 8 also may take on other, orientations, shapes and/or characteristics, e.g., akin to the variations in the raised fin constructions shown in FIGS. 6A through 6F.

Figure 9:
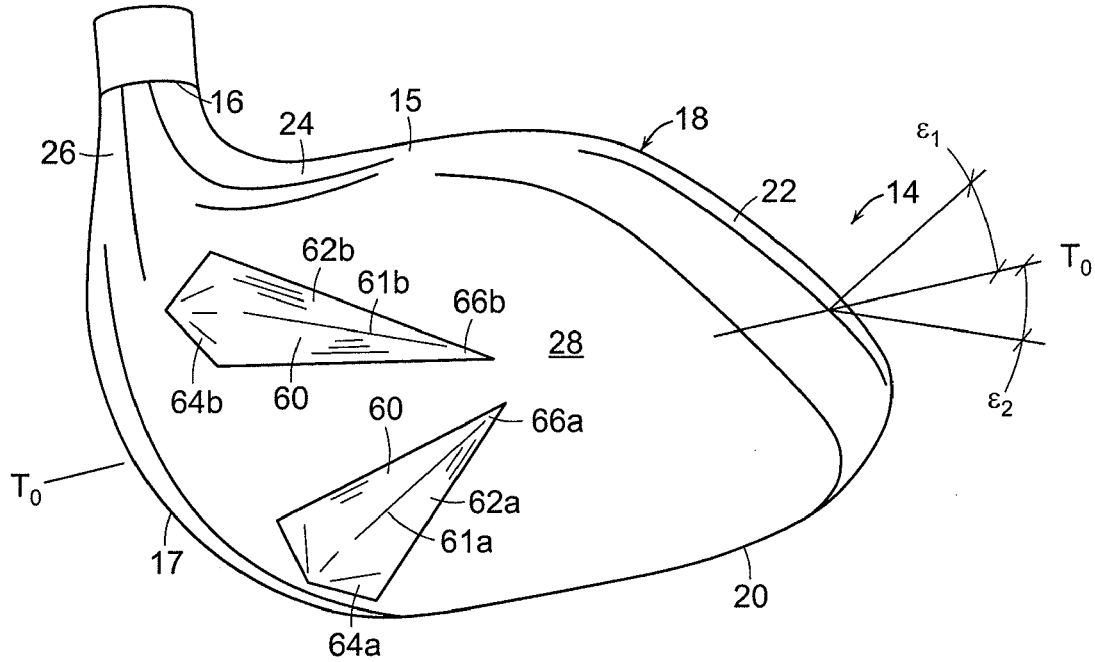
FIG. 9 is a perspective view of a club head, generally showing the sole region, the heel region and the rear portion of the club head, with at least one drag-reducing structure included on a surface of the club head according to even another illustrative aspect.

According to other aspects, as shown in FIG. 9, the sole region 28 may have an alternative drag-reduction feature 60. The drag-reduction feature 60 may include one or more elongated indentations 62 generally oriented from the front toward the rear of the club head 14. The drag-reduction feature 60 is configured to channel air flowing over the sole region 28 of the club head 14 generally from the ball striking face 17 toward the rear region 22.

The indentations 62 may include a first indentation 62*a* and a second indentation 62*b*. Each indentation 62 may include a lowermost contour 61, i.e., the deepest part of the indentation 62 extending along the elongated length of the indentation. The indentation 62*a* and its lowermost contour 61*a* are shown as extending in a generally linear fashion, at an angle $\epsilon_1$ relative to the $T_0$ centerline of the club head 14, from a forward portion of the club head 14 toward a rearward portion of the club head 14. Similarly, the indentation 62*b* and its lowermost contour 61*b* are shown as extending in a generally linear fashion, at an angle $\epsilon_2$ relative to the $T_0$ centerline of the club head 14, from the forward portion of the club head 14 toward a rearward portion of the club head 14. The indentations 62 and their lowermost contours 61 need not extend linearly from the forward portion toward the rearward portion. Thus, in certain aspects, one or both of the indentations 62 may be formed in a piecewise linear fashion. In other aspects, one of both of the indentations 62, or portions thereof, may be curved.

Angles $\epsilon_1$ and $\epsilon_2$ may be equal, but of opposite signs. Alternatively, angles $\epsilon_1$ and $\epsilon_2$ need not be equal. According to some aspects, the lowermost contours 61 of the indentations 62 may be oriented up to 45 degrees from the centerline $T_0$. Thus, in certain aspects, one or both of the angles $\epsilon_1$ and $\epsilon_2$ may range from approximately 1 degree to approximately 45 degrees. In other aspects, the angles $\epsilon_1$ and $\epsilon_2$ may range from approximately 5 degrees to approximately 25 degrees or from approximately 5 degrees to approximately 15 degrees. It may be preferred to have the relatively shallow angles $\epsilon_1$ and $\epsilon_2$ that range from approximately 5 degrees to approximately 10 degrees. Alternatively, it may be preferable to have one or both of the indentations 62 only very slightly angled, i.e., oriented up to a maximum of only approximately 5 degrees from the centerline $T_0$.

In the particular structure illustrated in FIG. 9, the indentations 62 extend from a forward-most end 64 adjacent the ball striking face 17 to a rearward-most end 66 located in a substantially central portion of sole region 28. As shown in FIG. 9, the indentation 62*a* is spaced apart from the indentation 62*b* at the forward portion of the club head 14 approximately equidistant from the centerline $T_0$ of the club head 14. By way of non-limiting examples, the forward-most ends 64*a*, 64*b* of the indentations 62 may be spaced apart from one another by approximately 20 mm to approximately 70 mm, by approximately 30 mm to approximately 60 mm, or by approximately 25 mm to approximately 50 mm. According to certain embodiments, the forward-most ends 64*a*, 64*b* of the indentations 62*a*, 62*b* need not be positioned equidistant from the centerline $T_0$ of the club head 14.

Also as shown in FIG. 9, the lowermost contours 61 of the indentations 62 converge toward each other as they extend toward the rearward portion of the club head 14. According to certain embodiments, the rearward-most ends 66*a*, 66*b* of the lowermost contours 61*a*, 61*b* of the indentations 62*a*, 62*b* may be abutted or joined to one another. According to other embodiments, the rearward-most ends 66*a*, 66*b* may be spaced apart from one another. By way of non-limiting examples, the rearward-most ends 66*a*, 66*b* of the lowermost contours 61*a*, 61*b* of the indentations 62 may be spaced apart from one another by approximately 2 mm to approximately 25 mm, by approximately 5 mm to approximately 15 mm, or by approximately 5 mm to approximately 10 mm. According to certain embodiments, the rearward-most ends 66*a*, 66*b* of the lowermost contours 61*a*, 61*b* of the indentations 62*a*, 62*b* may be positioned equidistant from the centerline $T_0$ of the club head 14. According to even other embodiments, the rearward-most ends 66*a*, 66*b* of the lowermost contours 61*a*, 61*b* of the indentations 62*a*, 62*b* may be positioned different distances from the centerline $T_0$, and in some example structures, the rearward-most ends 66*a*, 66*b* may both be positioned to the same side of the centerline $T_0$.

According to certain embodiments, the indentations 62 may extend into the surface of the sole region 28 by a depth $D_{SI}$. Typically, the indentations 62 may have a maximum depth of up to approximately 8 mm. For certain structures, it may be advantageous for the indentations 62 to have a maximum depth of less than approximately 6 mm, or less than approximately 5 mm, or even less than approximately 3 mm. It may be preferable for the indentations 62 to have a maximum depth of between approximately 2 mm to approximately 6 mm or, for certain embodiments, to have a maximum depth of between approximately 2 mm to approximately 5 mm. The depth of indentation 62*a* may be the same as the depth of indentation 62*b*. Further, the depth of the indentations 62 may be greatest in the forward portion of the club head 14 and may be least in the rearward portion of the club head 14. In certain embodiments, the depth of the indentations 62 may decrease (e.g., linearly decrease) as the indentations 62 extend from the forward region to the rearward region of the club head 14. Optionally, the depth of the indentations 62 may be reduced to zero in the rear region 22 or at the rearward-most end 66 of the indentations 62.

The indentations 62 may be of any suitable shape, although a preferred shape may include a relatively wide opening that opens into a relatively shallow concavity, as best shown in FIG. 9. The width of the opening of the indentations 62 may range from approximately 2 mm up to approximately 10 mm, from approximately 2 mm up to approximately 7 mm, or even from approximately 3 mm to approximately 5 mm. In certain aspects, the cross-sectional shape of the indentations 62 may best be described as being substantially triangular in shape. The side surfaces of the elongated indentation may be straight or curved. Providing the indentations 62 with convexly curved sides would allow the indentations 62 to more smoothly merge into the surface of the sole region 28. Of course, the cross-sectional shape of the indentations 62 need not be constant along the length of the indentations 62. By way of non-limiting example, the width of the opening of the indentations 62 may be constant along the length of the indentations 62, while the depth of the indentations 62 may be at a maximum at, or near, the forward-most ends 64 of the indentations 62 and thereafter gradually decreasing to zero at the rearward-most ends 66 of the indentations 62.

As shown in FIG. 9, the forward-most end surface may be canted or sloped away from the ball striking face 17. Such a sloped surface may provide a smoother, more aerodynamic, transition from the sole region 28 to the indentations 62. Other options for the forward-most end surface of the indentations 62 may include those described above with respect to indentations 42 formed on the surface of the crown region 18. Additionally, the forward-most end 64 of the indentation 62 need not extend all the way to the ball striking face 17. By way of non-limiting examples, the forward-most end 64 of the indentation 62 may be positioned up to approximately 2 mm, up to approximately 5 mm, or even up to approximately 10 mm away from the ball striking face 17. Further, for purposes of this measurement, where the ball striking face 17 and the sole region 28 transition from one to the other, the ball striking face 17 includes the surface that is more vertical than horizontal and the sole region 28 includes the surface that is more horizontal than vertical, when the club 10 is in the address position.

As discussed above, the rearward-most end 66 of the indentation 62 may smoothly and tangentially merge into the surface of the sole region 28. In other words, the depth of the indentation 62 may gradually decrease to zero at the rearward-most end 66. Alternatively, the rearward-most end 66 of the indentation 62 may extend below the surface of the sole region 28, such that a more abrupt end of the indentation 62 is provided. In such case, according to certain embodiments, the rearward-most end 66 may taper up to a relatively thin trailing edge. Additionally, the rearward-most end 66 of the indentation 62 need not extend all the way to the rear region 22 of the club head 14. By way of non-limiting examples, the rearward-most end 66 of the indentation 62 may be positioned up to approximately 2 mm, up to approximately 5 mm, up to approximately 10 mm, or even up to approximately 20 mm away from the rear region 22. For purposes of this measurement, where the rear region 22 and the sole region 28 transition from one to the other, the rear region 22 includes the surface that is more vertical than horizontal and the sole region 28 includes the surface that is more horizontal than vertical, when the club 10 is in the address position.

The indentation drag-reduction features on the sole portion like those shown in FIG. 9 also may take on other orientations, shapes and/or characteristics, e.g., akin to the variations in the raised fin constructions shown in FIGS. 6A through 6F.

According to certain aspects, one or more of the drag-reduction features 30, 40, 50, 60 may be included on any given club head 14. Further, the drag-reduction features 30, 40, 50, 60 may include more that two fins 32, 52, more than two indentations 42, 62, or any desired combination of fins and indentations.

The one or more drag-reduction features 30, 40, 50, 60 may be oriented to mitigate drag not only when the ball striking face 17 is leading the swing, but also during other portions of the downswing stroke, particularly as the club head 14 rotates around the yaw axis. Thus, in certain configurations, one or more of the fins 32, 52 and/or indentation 42, 62 of the drag-reduction features 30, 40, 50, 60 may be oriented to channel the air flow when the hosel region 26 and/or a portion of the heel region 24 lead the swing. For example, FIG. 6F shows a drag-reduction feature 30 oriented generally from the hosel region 26 or from a region adjacent the hosel region back toward the rear region 22 of the club head 14

Thus, by way of non-limiting example, one or both of the fins 32, 52 and/or indentations 42, 62 of the drag-reduction features 30, 40, 50, 60 may be curved so as to provide a generally convex aspect when viewed from the heel region 24. In certain configurations, both fins and/or indentations may curve in the same general direction toward the rear 22 as the drag-reduction feature 30, 40, 50, 60 extends away from the ball striking face 17. This generally curvature of the drag-reduction feature 30, 40, 50, 60 may enhance the ability to delay the transition of the airflow from laminar to turbulent over a greater yaw angle range of the club 10.

Other drag-reducing structures, for example, such as chamfers and/or fairings between the various regions of the club head 14 may be provided in combination with one or more of the drag-reduction feature 30, 40, 50, 60 in order to reduce the drag on the club head during a user's golf swing from the end of a user's backswing throughout the downswing to the ball impact location.

While there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements which perform substantially the same function, in substantially the same way, to achieve the same results are within the scope of the invention. Substitutions of elements from one described embodiment to another are also fully intended and contemplated. It is the intention, therefore, to be limited only as indicated by the scope of the appended claims.

What is claimed is:

1. A golf club head comprising: a body member having a ball striking face, a crown region, a toe region, a heel region, a sole region, a rear region and a hosel region; the body member having a drag-reduction feature that includes a first elongated fin and a second elongated fin, the first and second fins extending in a generally ball striking face-to-rear region orientation up to 45 degrees from a front-to-rear centerline of the club head, each fin having an uppermost edge extending between a forward-most end and a rearward-most end, the uppermost edge of the first fin and the uppermost edge of the second fin being spaced farther apart at their forward-most ends than at their rearward-most ends; wherein the first fin is angled from approximately 10 degrees to approximately 45 degrees from a front-to-rear centerline of the club head; and wherein the second fin is oppositely angled from approximately negative 10 degrees to approximately negative 45 degrees from the front-to-rear centerline of the club head.

2. The golf club head of claim 1, wherein the drag-reduction feature is located on the crown region.

3. The golf club head of claim 1, wherein the uppermost edges of the first and second fins taper down and merge at the rearward-most ends with the surface on which the drag-reduction feature is located.

4. The golf club head of claim 1, wherein the forward-most ends of the fins are located within 10 mm of the ball-striking face.

5. The golf club head of claim 1, wherein the rearward-most ends of the fins are located within 10 mm of the rear region.

6. The golf club head of claim 1, wherein the first and second fins are formed with a height and a length, and the height of the first fin is approximately constant over a majority of its length.

7. The golf club head of claim 1, wherein the first and second fins are formed with a cross-sectional area and a length, and the cross-sectional area of the first fin is approximately constant over a majority of its length.

8. The golf club head of claim 1, wherein the first fin has at least one concave side surface and wherein the at least one concave side surface merges smoothly with the surface from which the first fin projects.

9. A golf club comprising:

a shaft; and the golf club head according to claim 1, wherein the golf club head is secured to a first end of the shaft.

10. The golf club head of claim 1, wherein the orientation of the first fin is greater than approximately 5 degrees and less than approximately 45 degrees from a front-to-rear centerline of the club head.

11. The golf club head of claim 1, wherein the first and second fins are formed with a height and a length, and the height of the first fin decreases as the fin extends toward the rear of the club head.

12. The golf club head of claim 1, wherein the first and second fins are formed with a cross-sectional area and a length, and the cross-sectional area of the first fin decreases as the fin extends toward the rear of the club head.

13. The golf club head of claim 1, wherein the first and second fins are oriented asymmetrically with respect to the front-to-rear centerline of the club head.

* * * * *